US006013410A

United States Patent [19]

Arai

[11] Patent Number: 6,013,410

[45] Date of Patent: Jan. 11, 2000

[54] SILVER HALIDE PHOTOGRAPHIC LIGHT-SENSITIVE MATERIAL

[75] Inventor: Takeo Arai, Hino, Japan

[73] Assignee: Konica Corporation, Japan

[21] Appl. No.: 09/042,133

[22] Filed: Mar. 13, 1998

[30] Foreign Application Priority Data

Mar. 21, 1997 [JP] Japan ..... 9-067991

[51] Int. Cl.[7] ..... G03C 1/795; G03C 1/89; G03C 1/93; G03C 1/295

[52] U.S. Cl. ..... 430/264; 430/523; 430/527; 430/533; 430/534; 430/535; 430/536; 430/531; 430/961

[58] Field of Search ..... 430/523, 527, 430/534, 539, 961, 631, 264, 531, 533, 536, 535

[56] References Cited

U.S. PATENT DOCUMENTS

| | | | |
|---|---|---|---|
| 3,143,421 | 8/1964 | Nadeau . | |
| 4,190,449 | 2/1980 | Naoi et al. | 430/961 |
| 4,264,719 | 4/1981 | Kameoka et al. | 430/961 |
| 4,777,113 | 10/1988 | Inove et al. | 430/961 |
| 5,223,384 | 6/1993 | Ohbayashi et al. | 430/203 |
| 5,288,598 | 2/1994 | Sterman et al. | 430/523 |
| 5,378,577 | 1/1995 | Smith et al. | 430/523 |
| 5,631,124 | 5/1997 | Ikuhata et al. | 430/523 |

FOREIGN PATENT DOCUMENTS

| | | |
|---|---|---|
| 0476429 | 3/1992 | European Pat. Off. . |
| 0595274 | 4/1994 | European Pat. Off. . |
| 0678776 | 10/1995 | European Pat. Off. . |
| 0716338 | 6/1996 | European Pat. Off. . |
| 0726489 | 8/1996 | European Pat. Off. . |
| 1234755 | 6/1971 | United Kingdom . |

OTHER PUBLICATIONS

European Search Report EP 98 30 2107.

*Primary Examiner*—Richard L. Schilling
*Attorney, Agent, or Firm*—Jordan B. Bierman; Bierman, Muserlian and Lucas

[57] ABSTRACT

A silver halide photographic light-sensitive material is disclosed. The light-sensitive material comprises a support having thereon a subbing layer having a glass transition point Tg of 40° C. to 200° C. which comprises a hydrophobic resin, and a silver halide emulsion layer and optionally a non-light-sensitive hydrophilic colloid layer provided on the subbing layer, and at least one of the silver halide emulsion layer and the non-light-sensitive hydrophilic colloid layer contains an inorganic colloidal particle or a composite latex comprising an inorganic particle and a hydrophobic resin in an amount of 0.1 $g/m^2$ to 2.0 $g/m^2$ of in total.

4 Claims, No Drawings

SILVER HALIDE PHOTOGRAPHIC LIGHT-SENSITIVE MATERIAL

FIELD OF THE INVENTION

This invention relates to a silver halide photographic light-sensitive material, particularly relates to a silver halide photographic light-sensitive material for photomechanical use in which a peeling electrification is reduced and a resistivity to scratch is improved.

BACKGROUND OF THE INVENTION

Recently, silver halide photographic light-sensitive material, hereinafter simply referred to a light-sensitive material, is usually conveyed automatically from the step of exposure to that of the completion of processing. Light-sensitive material is improved to be high sensitive year by year. On the other hand, accompanied with raising in the sensitivity, a line-shaped blacken fogging, so called a scratch pressure mark, tend to be occurred, which is caused by scratching by a protrusion in the course of conveying the light-sensitive material. Such the phenomenon is intensively occurred when a hydrazine compound is used in a high sensitive light-sensitive material as an agent for obtaining an extremely high contrast. Such the problem is a serious impediment in the extremely high contrast light-sensitive material for image output, the use of which is extended for responding to FM screening and a high precise printing technology. Accordingly, improvement of such the problem has be strongly demanded.

As a method for raising the resistivity of the light-sensitive material against pressure, a method for decreasing the surface friction of the light-sensitive material by the use of a matting agent or a lubricant in the surface layer, or a method by controlling the stiffness of the binder, have been known. However, effects of these methods is sufficient not always, and further improvement has been demanded.

SUMMARY OF THE INVENTION

The object of the invention is to provide a light-sensitive material which has a high sensitivity, and is lowered in the peeling electrification and protected from the formation of scratch pressure mark.

Another object of the invention is to provide an extremely high contrast light-sensitive material for photomechanical use.

The objects of the invention is attained by a silver halide photographic light-sensitive material comprising a support having thereon a subbing layer comprising a hydrophobic resin having a glass transition point Tg of 40° C. to 200° C., and a silver halide emulsion layer and optionally a non-light-sensitive hydrophilic colloid layer provided on the subbing layer, and the silver halide emulsion layer and the non-light-sensitive hydrophilic colloid layer contain an inorganic colloidal particle or a composite latex comprising an inorganic particle and a hydrophobic resin in an amount of 0.1 g/m$^2$ to 2.0 g/m$^2$ of in total.

DETAILED DESCRIPTION OF THE INVENTION

In the invention, the support has a subbing layer on a surface thereof. The subbing layer in the invention is a layer of a hydrophobic polymer for raising the adhesiveness between the plastic support and an emulsion layer or another hydrophilic colloid layer.

In the invention, the light-sensitive material has at least one silver halide emulsion layer, and optionally a non-light-sensitive hydrophilic layer on the subbing layer provided on one surface of the plastic support. The silver halide emulsion layer and the hydrophilic colloid layer provided on the emulsion-coated side of the support each may be single-layer or multi-layered. In the invention, the hydrophilic colloid layer may includes various kinds of layer, for example, a protective layer, an interlayer, a dyed layer, and an under-coating layer.

In the invention, the subbing layer coated on the film support a layer which comprises a hydrophobic polymer and has a Tg of 40° C. to 200° C., preferably 50° C. to 150° C. When the subbing layer is composed of plural layers, at least one of them is a hydrophobic resin layer having a Tg of 40° C. to 200° C. The glass transition point Tg is a critical temperature at which a polymer in a molten state is solidified to a glass state. The Tg is a concept well known in the field of polymer technology.

The Tg value of the subbing layer can be determined by the brittle point or the softening point thereof as described in Matsuda et al. "High Molecular Materials" I: Basic Part, 1.: Physical Chemistry, Sanngyou Tosho Co., Ltd. The softening point can be measured according to JIS K-7196 "Test Method for Softening Point of Thermoplastic Film and Sheet by Thermal Instrumental Analysis". In the invention, the Tg value is measured by a measuring apparatus TM-7000L manufactured by Shinkuu Rikou Co., Ltd., according to a method according to JIS K-7196.

In concrete, the procedure of the measurement is as follows: A sample of 5 mm×5 mm is stand on a measuring table and the temperature of the sample is raised in a rate of 5° C. per minutes, a cylindrical rod having a diameter of about 0.5 mm is perpendicularly set to the sample and a pressure of 0.5 N is applied to the rod, and the inroad of the rod in to the sample is measured for obtaining the relation between the temperature and the inroad of the rod. The Tg is defined by the temperature at which an extended line of the straight line in the low temperature region in which the rod is not made inroad in the layer, and the tangential line at the point at which the increasing rate of the inroad of the rod is the maximum are crossed. Thus obtained temperature is calibrated by the measured value of a metal for melting point calibration such as indium. The measurement is carried out using a subbed film including the support.

It has been well known that the addition of colloidal silica into the hydrophilic colloid layer is effective as a counter-measure against the fogging caused by a scratch pressure.

However, the invention is carried out upon the find by the inventors that the presence of an inorganic colloidal particle and the Tg of the subbing layer of hydrophobic polymer are related to the peeling electrification of the outermost layer, and the combination the specified amount of the inorganic particle and the hydrophobic polymer subbing layer having a specified Tg value is effective to raise the resistivity against the scratch pressure mark. Such the effects could not be expected before the investigation. The inorganic particle may be added in a form of a composite latex comprised of the inorganic particle together with a hydrophobic polymer.

The Tg value tends to be higher in a polymer having a high polarity, an asymmetrical structure, and a high polymerization degree. The Tg of a copolymer can be approximated by the following equation:

$$1/Tg \approx W_a/Tg_a + W_b/Tg_b$$

wherein $W_a$ and $W_b$ are each a specific gravity of components a and b, and $Tg_a$ and $Tg_b$ are each a Tg of component a and b, respectively, cf. L. E. Nielsen (translated by S. Onogi) "Dynamic characteristics of high molecular substance and composite material" published by Kagaku Doujin Sha. Accordingly, Tg of a polymer can be properly controlled by selecting the constituting component and the ratio of the components.

Examples of the polymer having a Tg of lower than 40° C. include polyethylene, poly-n-butyl acrylate, polyethyl acrylate, polyvinylidene chloride, polymethyl acrylate, poly-n-butyl methacrylate and polyvinyl acetate. Examples the polymer having a Tg of near 40° C., within the range of ±5° C., include polyglycidyl methacrylate and poly-t-butyl acrylate, and examples of a polymer having a Tg higher than 40° C. include polymethyl methacrylate, polyvinyl chloride, polystyrene, polymethyl methacrylate, polyacrylic acid and polyacrylonitryl. A polymer having a Tg of not lower than 40° C. can be obtained by polymerizing a monomer or monomers giving a Tg of not lower than 40° C. Polymers or copolymers which are different from each other in the Tg thereof, are combined to form the subbing layer. The Tg of thus formed layer can be approximated by the foregoing equation with respect to Tg of each of the component polymer latex. When the layer shows plural Tg points, in the invention, the Tg of the layer is defined by the lowest Tg, and it is necessary that such the lowest Tg is not lower than 40° C.

As the monomer to form a Tg not lower than 40° C., styrene, methyl methacrylate, t-butyl acrylate, glycidyl methacrylate and butyl acrylate are preferred. For obtaining a high Tg value, styrene and methyl methacrylate are particularly preferred. The Tg of the subbing layer according to the invention is a temperature of from 40° C. to 200° C., and a Tg of from 40° C. to 100° C. is particularly preferred. A Layer having a Tg without the range required in the invention may be exist between the subbing layer according to the invention or between the subbing layer and the hydrophilic colloid layer.

In the invention, the silver halide emulsion layer and/or the hydrophilic colloid layer provided on the subbing layer contains a colloidal inorganic particle or a composite latex comprising a inorganic particle and a hydrophobic polymer in an amount of 0.1 to 2.0 g/m$^2$, preferably 0.3 to 1.5 g/m$^2$, in total. The composite latex is a latex of a fine particle of a hydrophobic resin containing an inorganic particle such as ones described in EP-A-772083. The composite latex can be prepared by a method described in EP-A-772083.

In the invention, the amount of the metal oxide is preferably from 1 to 2,000 parts by weight, more preferably 30 to 1,000 parts by weight of the hydrophobic polymer.

The colloidal inorganic particle to be added in the silver halide emulsion layer or the hydrophilic colloid layer or that to be used in the composite latex together with the hydrophobic polymer includes a particle of a metal oxide, nitride or sulfide, and the metal oxide is preferred.

As the metal oxide, a single or compound oxide particle of the following metal is preferred: Na, K, Ca, Ba, Al, Zn, Fe, Cu, Ti, Sn, In, W, Y, Sb, Mn, Ga, V, Nb, Tu, Ag, Bi, B, Si, Mo, Ce, Cd, Mg, Be, or Pb. Among them, a single or compound oxide particle of Y, Sn, Ti, Al, V, Sb, In, Mn, Ce, B, or Si is preferred from the viewpoint of miscibility with the emulsion.

Such the metal oxide may be preferably used even when the metal oxide is crystalline or amorphous, and amorphous one is particularly preferred. The average diameter of the metal oxide particles is preferably 0.5 to 3,000 nm, more preferably 3 to 500 nm. Such the metal oxide particles are preferably in a form of dispersion in water or a water-soluble solvent. Furthermore, the inorganic colloidal particle may be added into the emulsion layer or the hydrophilic colloid layer in a form of a composite latex comprising the inorganic particle and a hydrophobic polymer. Examples of preferable metal oxide are shown below.

| | |
|---|---|
| SO-1 | $SiO_2$ |
| SO-2 | $TiO_2$ |
| SO-3 | ZnO |
| SO-4 | $SnO_2$ |
| SO-5 | $MgO_2$ |
| SO-6 | $MnO_2$ |
| SO-7 | $Fe_2O_3$ |
| SO-8 | $ZnSiO_4$ |
| SO-9 | $Al_2O_3$ |
| SO-10 | $BeSiO_4$ |
| SO-11 | $AlSiO_5$ |
| SO-12 | $ZrSiO_4$ |
| SO-13 | $CaWO_4$ |
| SO-14 | $CaSiO_3$ |
| SO-15 | $InO_2$ |
| SO-16 | $SnSbO_2$ |
| SO-17 | $Sb_2O_5$ |
| SO-18 | $Nb_2O_5$ |
| SO-19 | $Y_2O_3$ |
| SO-20 | $CeO_2$ |
| SO-21 | $Sb_2O_3$ |
| SO-22 | $Na_2O$ |

In the composite latex of the invention, a hydrophobic monomer for composing the hydrophobic polymer includes, for example, a polymer of an acrylic acid ester, a methacrylic acid ester, a vinyl ester, an olefin, a styrene, a crotonic acid ester, an itaconic acid ester, an itaconic acid di-eter, a maleic acid di-eter, a fumaric acid ester, an allyl compound, a vinyl ether, a vinyl ketone, a vinyl heterocyclic compound, a glycidyl ester, an unsaturated nitryl and various kinds of unsaturated acid, which are used singly or in combination. As the hydrophobic monomer for composing the hydrophobic polymer of the invention is preferably an acrylic acid ester and/or a methacrylic acid ester, and a styrene are preferable, and ones having 6 carbon atoms in the ester group thereof is particularly preferable.

It is preferred that a hydrophobic monomer having a glycidyl group is contained in the hydrophilic monomers in an amount of 1.0 to 20% by weight, more preferably 2.0 to 10% by weight.

It is preferred to copolymerize a hydrophilic monomer with the hydrophobic monomer in the hydrophobic polymer of the composite latex usable in the invention. For example, a carboxyl group-containing monomer such as acrylic acid or methacrylic acid, a hydroxyl group-containing monomer such as hydroxyethyl acrylate, an alkylene oxide-containing monomer, an acrylamide, a methacrylamide, a sulfonic acid-containing monomer, and an amino group-containing monomer are preferably used as such the hydrophilic monomer. It is particularly preferred to contain the hydroxyl group-containing monomer, carboxyl group-containing monomer, amido group-containing monomer, or sulfonic group-containing monomer.

The content of the hydrophilic monomer is preferably 1 to 30% by weight, more preferably 1.0 to 20% by weight, since an excessive addition of the hydrophilic monomer makes the polymer to water soluble.

The composite latex of the invention can be made a composite latex having a cross-liking by selection of kind of the foregoing hydrophobic and/or hydrophilic monomer a monomer having a cross-linking group, for example, by the use of a hydrophobic polymer having a carboxyl group, a glycidyl group, an amino group or an N-methylol group.

In the composite latex of the invention, a monomer having at least two copolymerizable ethylenic unsaturated groups may be contained. Example of such the monomer includes, ones having two vinyl groups such as divinylbenzene, ethylene glycol diacrylate, ethylene glycol dimethacrylate, diethylene glycol diacrylate, diethylene glycol dimethacrylate, and N,N-methylenebisacrylamide, ones having three vinyl groups such as trivinylcyclohexane, trimethylolpropane triacrylate, and trimethylolpropane trimethacrylate, and ones having four vinyl groups such as pentaerythritol tetracrylate, and pentaerythritol tetramethacrylate. However the monomer is not limited thereto.

The average diameter of the composite latex of the invention is preferably 0.005 to 3.0 μm, particularly preferably 0.01 to 0.8 μm, in weight average diameter.

The polymerization method of the composite latex of the invention includes, for example, an emulsion polymerization method, a solution polymerization method, a lump polymerization method, a suspension polymerization method, and a radiation polymerization method.

An example of the solution polymerization is as follows: The latex is prepared by polymerization of a solution monomer composition having a proper concentration, usually not more than 40% by weight, preferably from 10 to 25% by weight, of the amount of the solvent, at a temperature of from 10 to 200° C., preferably from 30° C. to 120° C., for a time of from 0.5 to 48 hours, preferably from 2 to 20 hours, in the presence of an initiator. An initiator is optionally used as far as the initiator is soluble in the solvent. Examples of the initiator include an organic solvent-soluble initiator such as benzoyl peroxide, azo-bis-isobutylonitryl (AIBN) and di-tert-butyl peroxide, a water-soluble initiator such as ammonium persulfate (APS), Potassium peroxide, 2,2'-azo-bis(2-amidinopropane) hydrochloride, and a redox type polymerization initiator composed of the foregoing compound and a reducing agent such as a $Fe^{+2}$ salt or sodium hydrogensulfite.

As the solvent to be used in the polymerization process, one capable of dissolving the monomer composition is usable, for example, water, methanol, ethanol, dimethyl sulfoxide, dimethylformamide, dioxane and the mixture thereof are cited. After polymerization, the reaction liquid is pour into a poor solvent capable of hardly dissolving the polymer to precipitate the polymer. Then the polymer is dried. Thus the polymer can be separated from the unreacted composition.

Emulsion polymerization is carried out, for example, in the following manner. In water as the emulsification medium, a monomer in an amount of from 1% to 50% by weight of water is emulsified in the presence of an initiator in an amount of from 0.05% to 5% by weight and a dispersant in an amount of from 0.1 to 20% by weight of the monomer. The emulsified monomer is polymerized at a temperature of from 30° C. to 100° C., preferably from 60° C. to 90° C., for a time of from 3 to 8 hours while stirring.

As the dispersant in the composite latex according to the invention, a water-soluble polymer such as a synthesized and natural water-soluble polymer is preferably usable. Examples of the water-soluble synthesized polymer include, for example, one having a nonionic group, one having an anionic group, one having a cationic group, one having a nonionic group and an anionic group, one having a nonionic group and a cationic group, and one having an anionic group and a cationic group, in the molecular structure thereof. Examples of the nonionic group include an ether group, an alkylene oxide group, a hydroxyl group, an amido group and an amino group. As the anionic group, for example, a carboxyl group and its salt, phosphoric group and its salt, and a sulfo group and its salt are cited. As the cationic group, for example, a quatenary ammonium group and a tertiary amino group are cited.

Examples of the natural water-soluble polymer include, for example, one having a nonionic group, one having an anionic group, one having a cationic group, one having a nonionic group and an anionic group, one having a nonionic group and a cationic group, and one having an anionic group and a cationic group, in the molecular structure thereof.

As the water-soluble polymer, in the case of the synthesized and natural water-soluble polymer, one having an anionic group, and one having a nonionic group and an anionic group are preferably usable.

The usable water-soluble polymer has a water-solubility of not less than 0.05 g, more preferably not less than 0.1 g, per 100 g of water at 20° C. As the synthesized water-soluble polymer, one containing a repeating unit represented by the following Formula 1 and/or that represented by Formula 2 in an amount of from 10 to 100 mole % in one molecular of the polymer.

Formula 1

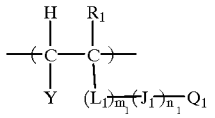

In Formula 1, $R_1$ is a hydrogen atom, an alkyl group, a halogen atom or a —$CH_2COOM$ group, and is preferably an alkyl group having from 1 to 4 carbon atoms. $L_1$ is a di-valent linking group, for example, a —CONH—, —NHCO—, —COO—, —OCO—, —CO— or —O—. $J_1$ is an alkylene group, an arylene group or a polyoxyalkylene group. $Q_1$ is —OM, —$NH_2$, —$SO_3M$, —COOM,

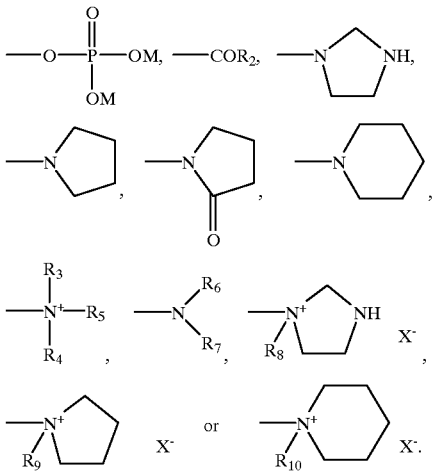

Among the above, —COOM and —$SO_3M$, particularly —$SO_3M$, is preferred. M is a hydrogen atom or a cation such as an alkali metal ion or ammonium ion, $R_2$, $R_3$, $R_4$, $R_5$, $R_6$, $R_7$, $R_8$, $R_9$, and $R_{10}$, are each an alkyl group having from 1 to 20 carbon atoms, $X^-$ is an anion. $m_1$ and $n_1$ are each 0 or 1. Y is a hydrogen atom or —$(L_2)m_2$—$(J_2)n_2$—$Q_2$, in which $L_2$, $J_2$, $Q_2$, $m_2$ and $n_2$ are each a synonym of $L_1$, $J_1$, $Q_1$, $m_1$ and $n_1$, respectively.

Formula 2

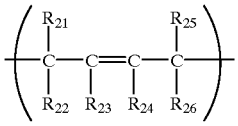

In Formula 2, $R_{21}$, $R_{22}$, $R_{23}$, $R_{24}$, $R_{25}$ and $R_{26}$ are each a hydrogen atom, an alkyl group having from 1 to 8 carbon atoms, an aryl group having from 6 to 20 carbon atoms or an —$SO_3X$ group, in which X is a hydrogen atom, an alkali metal atom, an alkali-earth metal atom, an ammonium group, or an amino group, and at least one of $R_{21}$, through $R_{26}$ is the —$SO_3X$ group.

The synthesized water-soluble polymer having the repeating unit represented by Formula 1 or 2 may be a homopolymer of the repeating unit represented by Formula 1 or 2, or one further containing another repeating unit.

As the other repeating unit, for example, one or a combination of two or more selected from an acrylic acid ester, a methacrylic acid ester, a vinyl ester, an olefin, a styrene, a crotonic acid ester, an itaconic acid di-ester, a maleic acid di-ester, a fumaric acid di-ester, an aryl compound, a vinyl ether, a vinyl ketone, a glycidyl ester, and an unsaturated nitryl is cited. An carylic acid ester, methacrylic acid ester and styrene are preferred. Examples of the water-soluble synthesized polymer are shown below.

PS-1

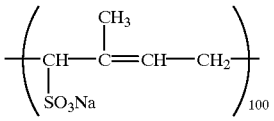

Mw = 20,000

PS-2

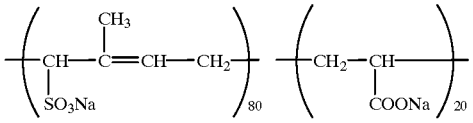

Mw = 30,000

PS-3

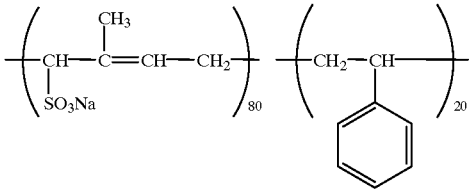

Mw = 40,000

PS-4

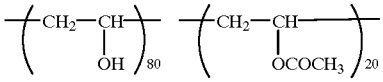

Mw = 40,000

PS-5

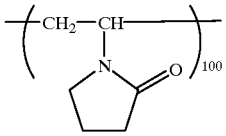

Mw = 9,000

-continued

PS-6

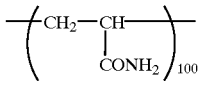

Mw = 20,000

PS-7

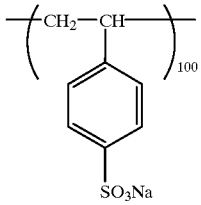

Mw = 10,000

SP-8

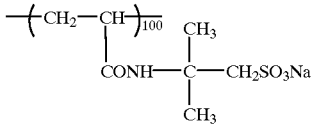

Mw = 20,000

SP-9

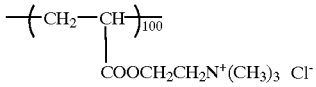

Mw = 10,000

SP-10

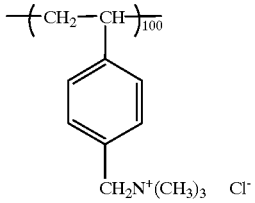

Mw = 150,000

SP-11

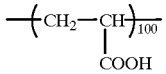

Mw = 40,000

SP-12

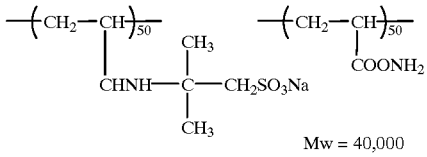

Mw = 40,000

SP-13

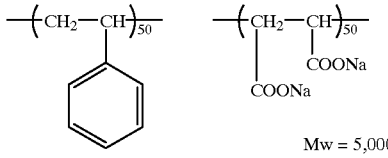

Mw = 5,000

SP-14

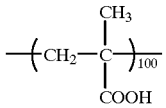

Mw = 20,000

As the natural water soluble polymer as the dispersant for the composite polymer to be used in the invention, ones described in "Comprehensive Collection of Technical material of Water-soluble Dispersing Method for Resin" Published by Keiei Kaihatsu Center, are usable. Lignin, starch, plurane, cellulose, dextran, dextrin, glycogen, arginic acid, gelatin, collagen, guar gum, gum arabic, laminaran, lichenin, and nigran and their derivatives are preferred. As the derivative of the natural water-soluble polymer, one in which a sulfo group, a carboxyl group, phosphoric group, an alkylenesulfo group, a carboxyalkylene group or an alkylphosphoric group is introduced is preferably used. Glucose, gelatin, dextran, cellulose, pluran, glucomannan, dextrin, geran gum, locust bean gum, xantan gum and their derivative are specifically preferred.

The use of a metal alcoxide compound is preferable for synthesizing the composite latex according to the invention. The metal alcoxide compound includes a compound so called as coupling agent. Various kinds of coupling agent such as a silane coupling agent, a titanium coupling agent, an aluminum coupling agent and a zirconium coupling agent are available on the market. Among them, the silane coupling agent and the titanium coupling agent are preferred.

Examples of preferable metal alcoxide compound are shown below.

ST-1

$Si(OCH_3)_4$

ST-2

$Ti(OC_3H_7)_4$

ST-3

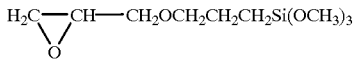

ST-4

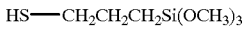

ST-5

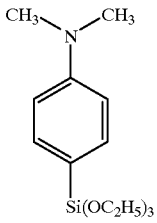

ST-6

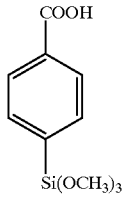

ST-7

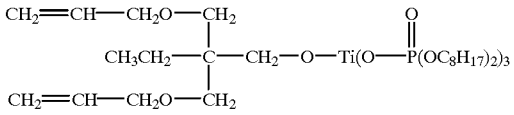

ST-8

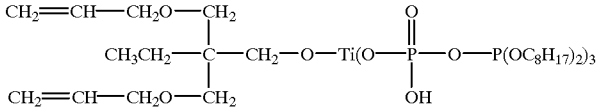

ST-9

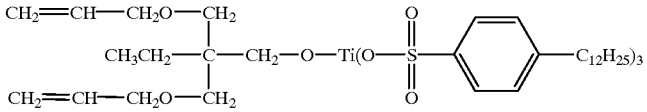

ST-10

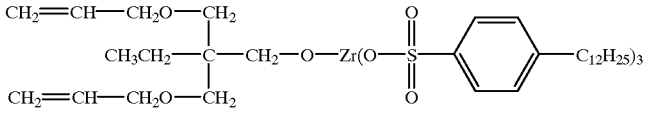

ST-11

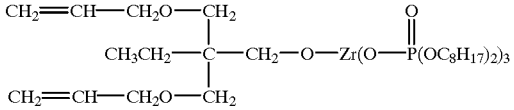

ST-12

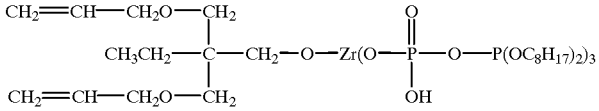

-continued

ST-13

$C_{10}H_{21}Si(OCH_3)_3$

ST-14

$CH_3(CH_2)_7Si(OC_2H_5)_3$

ST-15

$CH_2{=}CHSi(OC_2H_4OCH_3)_3$

ST-16

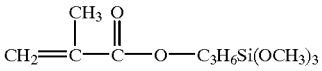

ST-17

$NH_2{-}C_2H_4{-}Si_9OCH_3)_3$

ST-18

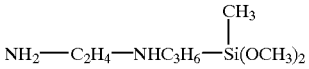

ST-19

$(CH_3O)_3Si{-}C_3H_6{-}NH{-}C_2H_4{-}NHCH_2COOH$

ST-20

$(CH_3O)_3Si{-}C_3H_6{-}NH{-}C_2H_4{-}NH{-}CH_2{-}CH{=}CH_2$

ST-21

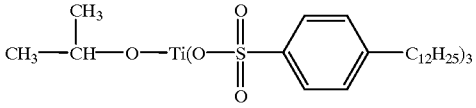

ST-22

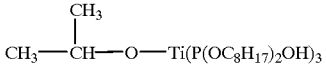

SI-23

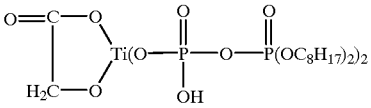

ST-24

$(C_8H_{17}{-}O)_2Ti(P(O{-}C_{13}H_{27})_2OH_2$

ST-25

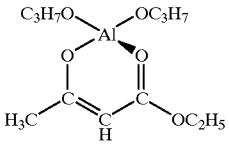

The composite polymer is contained in the photographic constituting layer in a form of aqueous dispersion or latex. An ultrasonic dispersing device, a ball mill, an attriter, perl mill, tree-roll mill, and a high speed grinding apparatus are preferably used for dispersing.

Examples of the composite polymer are shown below.

| No. | Hydrophobic polymer | Inorganic particle (weight % of hydrophilic polymer) | Metal alcoxide compound (weight % of hydrophilic polymer) | Dispersing agent (weight % of hydrophilic polymer) |
|---|---|---|---|---|
| PL-1 | $-(CH_2-C(CH_3)(COOCH_3))_{100}-$ | SO-17 (100) | — | SP-1 (10) |
| PL-2 | $-(CH_2-C(CH_3)(COOCH_3))_{80}-$ $-(CH_2-C(CH_3)(COOCH_2CH_2OH))_{20}-$ | SO-1 (100) | — | SP-5 (5) |
| PL-3 | $-(CH_2-C(CH_3)(COOCH_3))_{80}-$ $-(CH_2-C(CH_3)(COOCH_2CH_2OH))_{20}-$ | SO-4 (123) | — | Hydroxypropyl cellulose (22.5) |
| PL-4 | $-(CH_2-CH(COOC_2H_5))_{90}-$ $-(CH_2-C(CH_3)(COOCH_2CH_2OH))_{10}-$ | SO-1 (200) | — | SP-4 (5)<br>SP-1 (1) |
| PL-5 | $-(CH_2-CH(COOC_2H_5))_{98}-$ $-(CH_2-CH(COOH))_{2}-$ | SO-1 (200) | — | SP-4 (5)<br>SP-1 (5) |
| PL-6 | $-(CH_2-C(CH_3)(COO\text{-}C_6H_{11}))_{80}-$ $-(CH_2-C(CH_3)(COO(i)C_9H_{19}))_{20}-$ | SO-1 (200) | ST-3 (5) | SP-4 (10) |

-continued
| No. | Hydrophobic polymer | Inorganic particle (weight % of hydrophilic polymer) | Metal alcoxide compound (weight % of hydrophilic polymer) | Dispersing agent (weight % of hydrophilic polymer) |
|---|---|---|---|---|
| PL-7 | 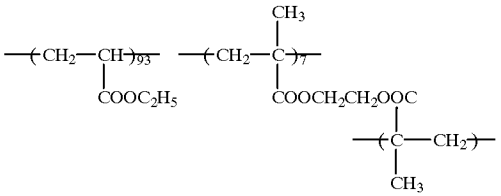 | SO-1 (300) | ST-16 (5) | SP-3 (10) |
| PL-8 | 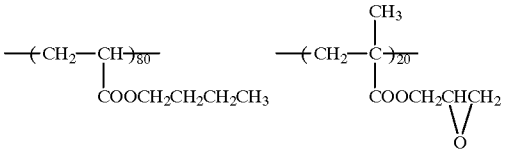 | SO-19 (100) | — | SP-3 (10) |
| PL-9 | 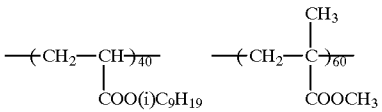 | SO-4 (200) | — | SP-1 (10) |
| PL-10 | 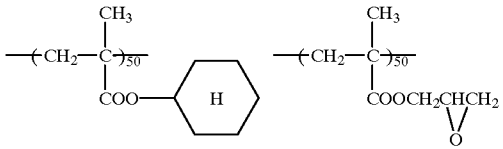 | SO-1 (500) | — | SP-3 (10) |
| PL-11 | 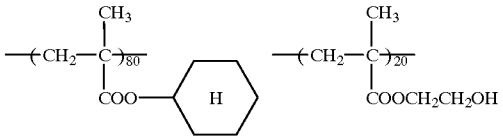 | SO-4 (200) | ST-16 (5) | SP-6 (10) |

-continued
| No. | Hydrophobic polymer | Inorganic particle (weight % of hydrophilic polymer) | Metal alcoxide compound (weight % of hydrophilic polymer) | Dispersing agent (weight % of hydrophilic polymer) |
|---|---|---|---|---|
| PL-12 | 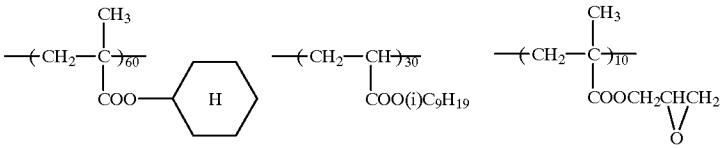 | SO-1 (200) | ST-16 (1) | SP-3 (10) |
| PL-13 | 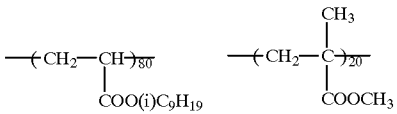 | SO-20 (100) | — | SP-1 (10) |
| PL-14 | 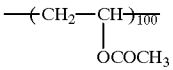 | SO-1 (300) | — | SP-3 (10) |
| PL-15 | 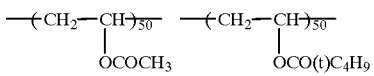 | SO-1 (300) | — | SP-3 (10) |
| PL-16 | 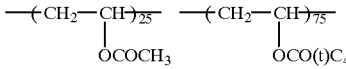 | SO-1 (300) | — | SP-3 (10) |
| PL-17 | 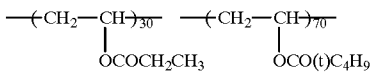 | SO-1 (300) | — | SP-3 (10) |
| PL-18 | 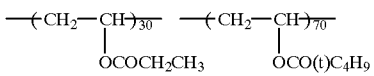 | SO-1 (300) | ST-16 (1) | SP-3 (10) |

-continued

| No. | Hydrophobic polymer | Inorganic particle (weight % of hydrophilic polymer) | Metal alcoxide compound (weight % of hydrophilic polymer) | Dispersing agent (weight % of hydrophilic polymer) |
|---|---|---|---|---|
| PL-19 | $-(CH_2-CH)_{30}-$ ($OCOCH_2CH_2CH_3$) $-(CH_2-CH)_{70}-$ ($OCO(t)C_4H_9$) | SO-1 (300) | — | SP-3 (10) |
| PL-20 | $-(CH_2-CH)_{26}-$ ($OCO(CH_2)_6CH_3$) $-(CH_2-CH)_{74}-$ ($OCO(t)C_4H_9$) | SO-1 (300) | — | SP-3 (10) |

Preparation examples of the composite latex are described below.

<Preparation example 1, preparation of composite latex L1>

To a flask of 1000 ml having four open mouths at which a stirrer, a thermometer, a dropping funnel, a nitrogen gas introducing pipe, and a flux cooler are arranged, respectively, 360 ml of distilled water, 126 g of a dispersion of colloidal silica having a silica content of 30% by weight are charged and heated so that the temperature of the contents is become 80° C. while deoxidizing by introducing nitrogen gas. Then 1.3 g of the following compound, 0.023 g of ammonium persulfate as an initiator, and 6.3 g of vinyl pivalate and 6.3 g ov vinyl acetate are added and reacted for 4 hours.

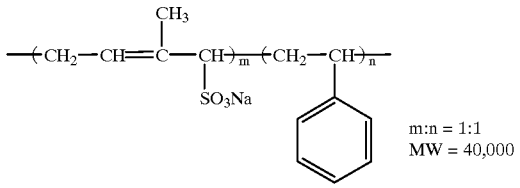

After reaction, the reacting liquid is cooled and the pH thereof is adjusted to 6 by sodium hydroxide to obtained composite latex L1.

<Preparation example 2, preparation of composite latex L2>

To a flask of 1000 ml having four open mouths at which a stirrer, a thermometer, a dropping funnel, a nitrogen gas introducing pipe, and a flux cooler are arranged, respectively, 360 ml of distilled water, 126 g of a dispersion of colloidal silica having a silica content of 30% by weight are charged and heated so that the temperature of the contents is become 80° C. while deoxidizing by introducing nitrogen gas. Then 4.5 g of hydroxylpropyl cellulose, and 1 g of dodecylbenzenesulfonic acid are added. Further 0.023 g of ammonium persulfate as an initiator, 12.6 g of vinyl acetate are added and reacted for 4 hours. After reaction, the reacting liquid is cooled and the pH thereof is adjusted to 6 by sodium hydroxide to obtained the following composite latex L2.

<Preparation example 3, preparation of composite latex L3>

Composite latex L3 is prepared in the same manner as in preparation example 1 except that 6.3 g of ethyl acrylate and 6.3 g of glycidyl acrylate are added in place of vinyl pivalate.

In the invention, composite acrylate resins included in VONCOAT DV series, manufactured by Dai-Nihon Ink Co., Ltd., are also preferably used which are available on the market.

Although the composite latex may be added to the emulsion by an optional procedure, it is preferable to add to the emulsion after chemical ripening thereof in a form of dispersion diluted with water or a hydrophilic solvent The colloidal silica is most preferable in the invention among the foregoing inorganic particles. The adding amount of the colloidal silica to the hydrophilic colloid layer is 0.1 to 2.0 g/m$^2$, preferably 0.3 to 1.5 g/m$^2$. This amount is the total of the amount of the colloidal silica contained all silver halide emulsion layers and the hydrophilic layers provided on the subbing layer of the emulsion-coated side of the support. The effects of the invention are sufficiently obtained when the amount of colloidal silica or composite latex containing silica particle is within such the range.

The inorganic colloidal particle such as the colloidal silica is added into one or more layers of emulsion layer and hydrophilic colloid layer provided on the subbing layer of the emulsion layer coated-side of the support. It is particularly preferred to be added to at least one silver halide emulsion layer.

It is particularly effective that the composite latex comprising the inorganic particles and the hydrophobic polymer is contained in the emulsion layer or the hydrophilic colloid layer.

In the silver halide photographic light-sensitive material of the invention, any support is usable, which includes a single layer plastic film and a laminated film formed by laminating such the single layer plastic film. Examples of the usable plastic film and laminated film include a cellulose film such as a cellulose triacetate and cellulose dictate, a polyolefin film such as polyethylene film, a polyester film, a polycarbonate film, a polystyrene film, and a polyethylene laminated paper. A polyester film is preferably used in the invention, which is suitable for the support of light-sensitive material and has a sufficient strength.

The polyester for composing the polyester film is a liner polyester principally formed by an aromatic dibasic acid or its ester and a diol or its ester. Example of such the polyester includes polyethylene terephthalate, polyethylene isophthalate, polybutylene terephthalate, poly(1,4-cyclohexylenedimethylene terephthalate), and polyethylene-2,6-naphthalene dicarboxylate. These polyesters include a copolymer, and a polyester blended with a little amount of another resin.

The polyester film can be produced by an ordinary method in which the polyester resin is molten and extruded in the form of film, and expanded for orientation crystallization and thermal crystallization.

The polyester film preferably usable in the invention, one orientedly crystallized so as to have a heat of fusion of crystal of not less than 4 cal/g measured by a scanning differential calorimeter in a nitrogen gas current under a condition of a temperature raising rate of 10° C. per minute.

The polyester film is preferably subjected to a corona discharge treatment, a glow discharge treatment, a plasma treatment, an UV irradiation treatment or a flame treatment for raising the adhesive ability with the hydrophilic colloid layer. On the support, a subbing layer comprising a hydrophobic resin is provided.

A polyethylene terephthalate support is used when the softening point of the subbing layer is 60° C. or less and a polyethylene naphthalate support is used when the softening point of the subbing layer is more than 60° C. for avoiding the softening of the support itself, even though the samples of light-sensitive material in the later-mentioned Example is all prepared by the use of a 100 $\mu$m polyethylene terephthalate support.

As the hydrophobic polymer to be used in the foregoing subbing layer, a styrene-acryl copolymer, a polyester having a hydrophilic group, a polyester modified with a vinyl copolymer and having a hydrophilic group, a vinylidene chloride copolymer, a styrene-butadiene copolymer, and an acrylic acid ester or/and methacrylic acid ester copolymer are usable. Among them, the styrene-acryl copolymer, a polyester having a hydrophilic group, a polyester modified with a vinyl copolymer and having a hydrophilic group, and acrylic acid ester or/and methacrylic acid ester copolymer are more preferable.

The styrene-acryl copolymer is preferably one having a ratio of styrene to acryl of 2/8 to 8/2, and is also may have an epoxy group-containing monomer, a monomer having a carboxyl group such as acrylic acid, methacrylic acid and salt thereof (sodium salt, potassium salt or ammonium salt) or a hydroxyl group-containing monomer as a third copolymerization component.

The polyester having a hydrophilic group is a substantially linear polymer synthesized from a polybasic acid or its derivative capable of forming an ester and a polyol or its derivative capable of forming an ester. As the polybasic acid component of the polymer, terephthalic acid, isophthalic acid, phthalic acid, 2,6-naphthalenedicarboxylic acid, 1,4-cyclohexane dicarboxylic acid, adipic acid, and trimellitic acid are cited. Two or more of them can be used in combination. As the polyol component, ethylene glycol, 1,4-hexanediol, 1,4-hexanedimethanol, diethylene glycol, and poly(ethylene oxide) glycol are cited. Two or more of them can be used in combination. It is preferable that the polyester contains a compound having a hydrophilic group such as an organic sulfonate, a carboxylate, a diethylene glycol, or a polyalkylene glycol. Particularly, it is advantageous to introduce the hydrophilic group by the sulfonate, diethylene glycol or polyalkylene glycol. An alkali sulfonate or an amine sulfonate such as pentasodium sulfoisophthalate, pentaammonium isophthalate, pentapotassium sulfoisophthalate, pentapotassium isophthalate and dipotassium sulfoterephthalte are preferably used as the compound having the sulfonate group.

In the light-sensitive material of the invention, the peeling electrification on the outermost layer of the light-sensitive material, which is generated by peeling the light-sensitive material from the surface of an isoprene rubber plate, is preferably 0 to 200 picocoulomb/cm$^2$, preferably 20 to 200 picocoulomb/cm$^2$ under a condition of 23° C. and 55% of relative humidity.

The peeling electrification is measured by the following procedure; a sample film to be measured is cut in a disk form having a diameter of 3 cm. The cut sample is contacted to the surface of a disk of isoprene rubber having a diameter of 1.5 cm and instantaneously peeled off from the surface. The electrification of the surface is measured by an ordinary method from just after the peeling and the maximum value of the electrification was determined. The measurement is repeated 3 times and the average value of the tree measured values is defined as the peeling electrification of the sample. The measurement is carried out under at a temperature of 23° C. and a relative humidity of 55%.

The resistivity against scratch pressure of the light-sensitive material in the course of conveyance can be raised by controlling the peeling electrification so as to be within this range.

A known method can be applied for controlling the peeling electrification with respect to isoprene rubber of the outermost layer of the light-sensitive material. A material capable of changing the electrification raw is added to the outermost layer according to the known method. A fluorine-containing surfactant is principally used in usual.

Moreover, a fluorine-containing particle such as a particle of fluorine-containing organic polymer or 4-fluoro ethylene, and an inorganic or organic matting agent, on the surface of which is treated by fluorine, are also usable.

It is preferred that a hydrazine derivative in an amount of sufficient to form an extremely high contrast is contained in the silver halide emulsion layer and/or the hydrophilic colloid layer. A compound represented by the following Formula [H] is preferably used as the hydrazine derivative.

Formula [H]

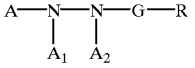

In the formula, A represents an aryl group, or a heterocyclic group including at least one sulfur atom or oxygen atom, G represents a —(CO)$_n$— group, a sulfonyl group, a sulfoxy group, a —P(=O)R$_2$— group or an iminomethylene group, n represent an integer of 1 or 2, both of $A_1$ and $A_2$ represent each a hydrogen atom or one of $A_1$ and $A_2$ represents a hydrogen atom, and the other of them represents substituted or unsubstituted alkylsulfonyl group or a substituted or unsubstituted acyl group, R represents a hydrogen atom or an alkyl group, an alkenyl group, an aryl group, an alkoxy group, an alkenyloxy group, an aryloxy group, a heterocyclic oxy group, an amino group, an carbamoyl group, or an oxycarbonyl group, and each of the above mentioned groups includes substituted one and unsubstituted one, respectively. $R_2$ represent an alkyl group, an alkenyl group, an aryl group, an alkoxy group, an alkenyloxy group, an alkynyloxy group, an aryl group, or an amino group, and each of the above mentioned groups include substituted one and unsubstituted one, respectively.

A compound represented by the following Formula [Ha] is more preferably among the compounds represented by Formula [H].

Formula [Ha]

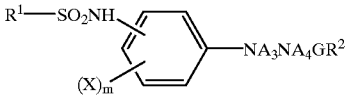

In the formula, $R^1$ represents an aliphatic group (such as an octyl group and a decyl group), an aromatic group (such as a phenyl group, a 2-hydroxyphenyl group, and a chlorophenyl group) or a heterocyclic group (such as a pyridyl group, a thienyl group and a furyl group), each of these groups preferably has a substituent. Furthermore, it is preferable that the group represented by $R^1$ has a ballast group or a group accelerating adsorption to silver halide.

A ballast group usually used in an immobile photographic additive such as a coupler is preferred as the anti-diffusion group. As the ballast group, a group which has 8 or more carbon atoms and is relatively inactive to the photographic property such as an alkyl group, an alkenyl group, an alkynyl group, an alkoxy group, a phenyl group, a phenoxy group, and an alkylphenoxy group are cited.

As the group accelerating adsorption to silver halide, a thiourea residue, a thiourethane group, a mercapto group, a thioether group, a thione group, a heterocyclic group, a thioamido-heterocyclic group, a mercaptoheterocyclic group, and a group described in Japanese Patent Publication Open to Public Inspection (JP O.P.I.) No. 64-90439.

In Formula [Ha], X represents a group capable of being a substituent of a phenyl group, m represents an integer of 0 to 4, and Xs may be the same or different when m is 2 or more.

In Formula [Ha], $A_3$ and $A_4$ are each a synonymous $A_1$ and $A_2$ defined in Formula [H], respectively, and both of them are preferably hydrogen atoms.

In Formula [Ha], G represents a carbonyl group, a sulfonyl group, a sulfoxy group, a phosphoryl group or an iminomethylene group, and the carbonyl group is preferred.

In Formula [Ha], $R^2$ represents a hydrogen atom, an alkyl group, an alkenyl group, an alkynyl group, an allyl group, a heterocyclic group, an alkoxy group, a hydroxide group, an amino group, a carbamoyl group, or an oxycarbonyl group. A —COOR$^3$ group, and a —CO($R^4$) ($R^5$) group are most preferable ($R^3$ represents an alkynyl group, or a saturated heterocyclic group, $R^4$ represents a hydrogen atom, an alkyl group, an alkenyl group, an alkynyl group, an aryl group, or a heterocyclic group, and $R^5$ represents an alkenyl group, an alkynyl group, a saturated heterocyclic group a hydroxy group or an alkoxy group.).

Examples of the compound represented by Formula [H] are shown below, the compound usable is not limited thereto.

H-1
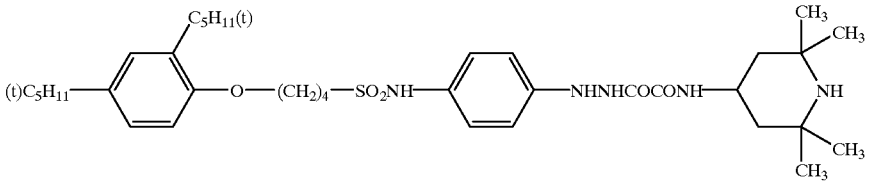
H-2
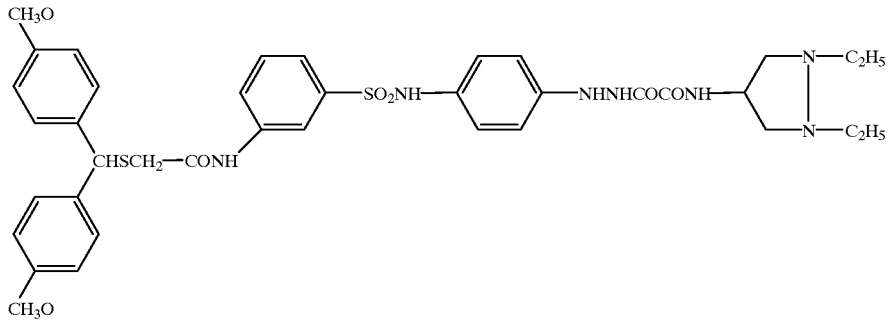
H-3
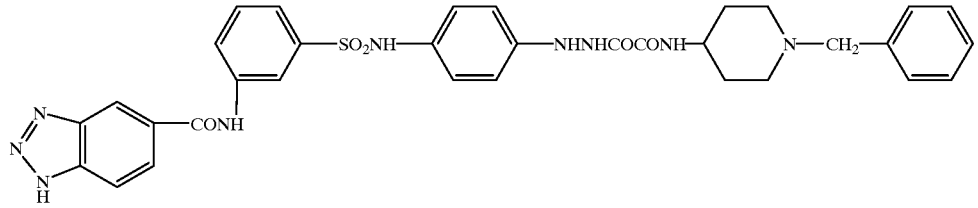
H-4
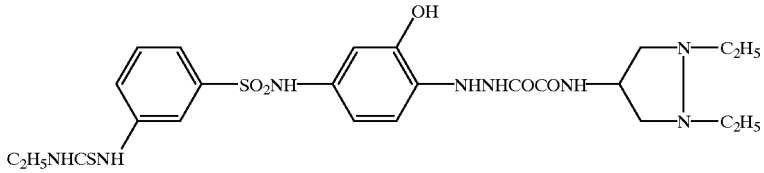
H-5
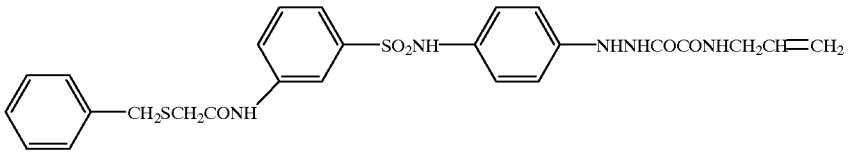
H-6
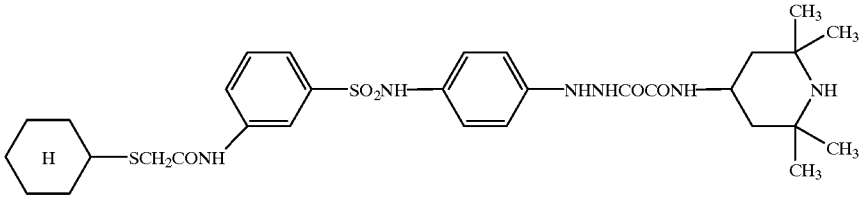
H-7
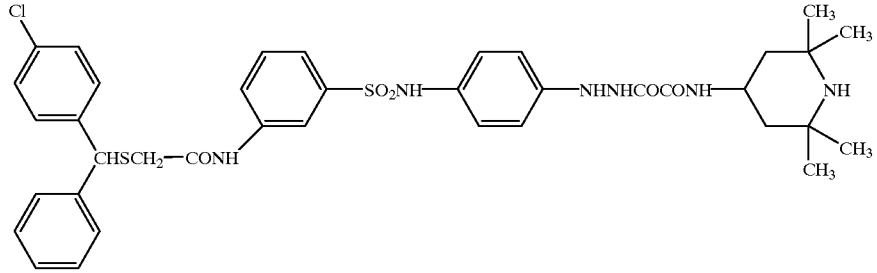

-continued
H-8
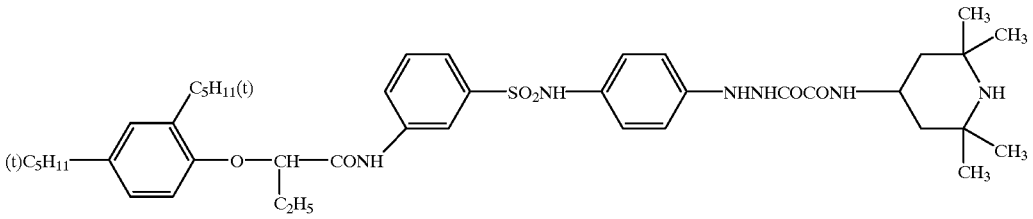
H-9
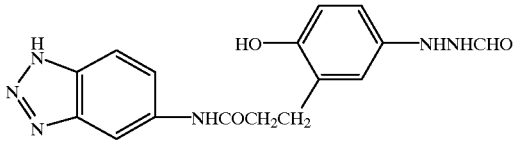
H-10
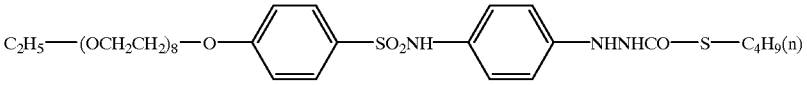
H-11
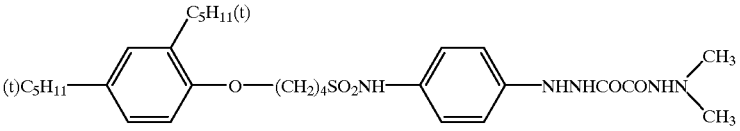
H-12
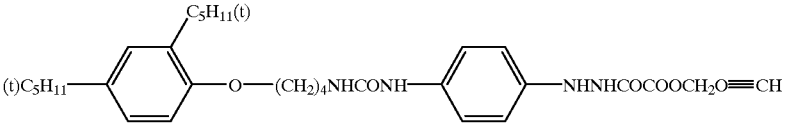
H-13
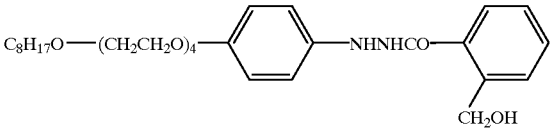
H-14
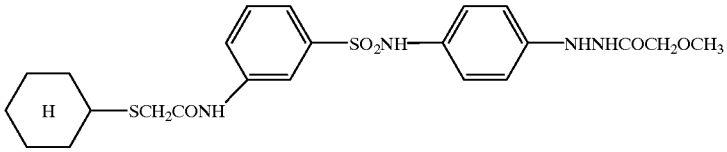
H-15
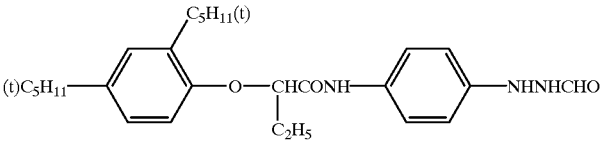
H-16
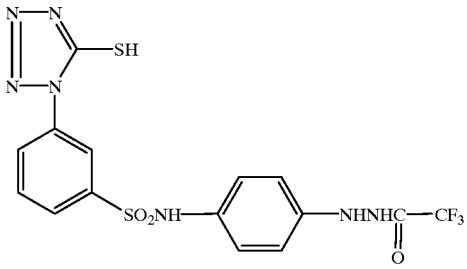

-continued
H-17
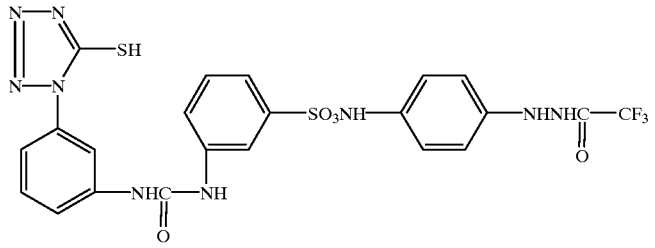
H-18
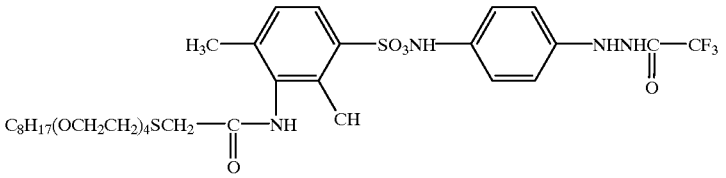
H-19
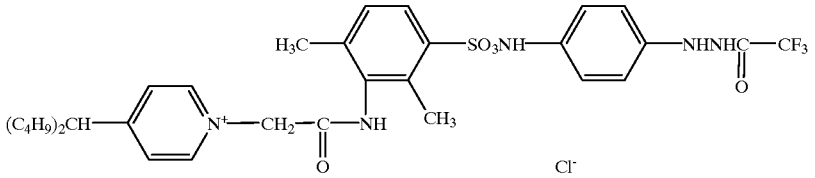
H-20
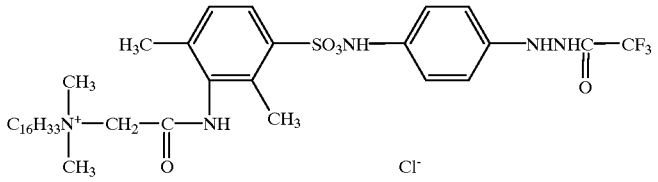
H-21
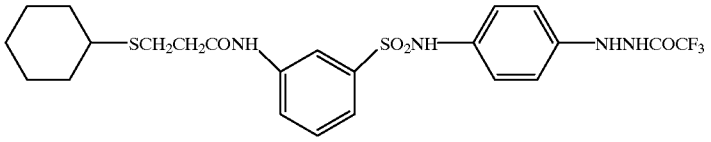
H-22
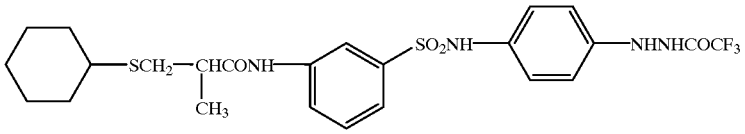
H-23
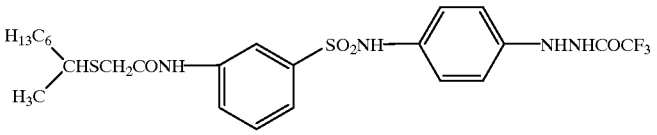
H-24
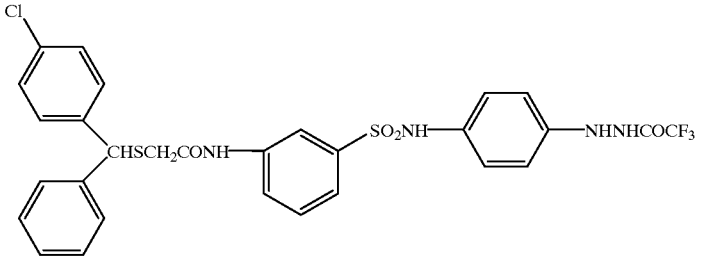

-continued

H-25

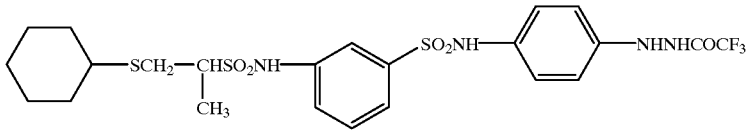

H-26

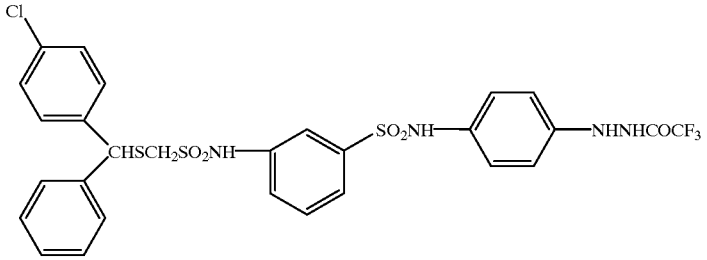

H-27

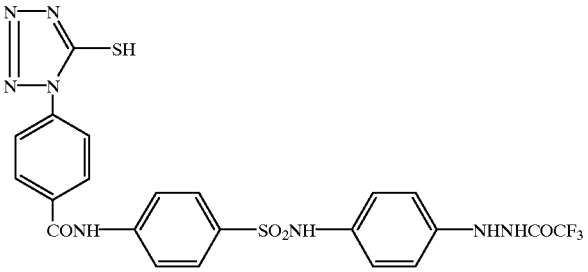

H-28

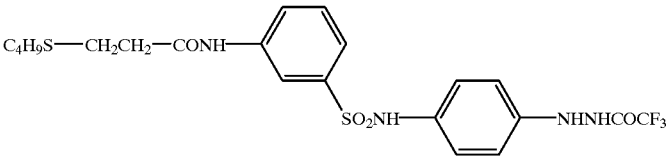

H-29

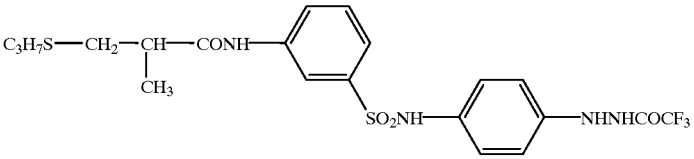

H-30

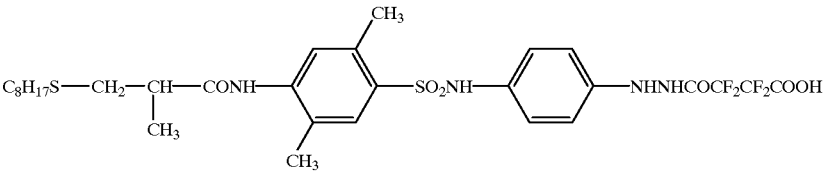

Examples of the preferably usable hydrazine compound are (1) to (252) described in U.S. Pat. No. 5,229,248, column 4 to column 60.

The hydrazine derivative can be synthesized by a know method, such as described in U.S. Pat. No. 5,229,248, column 59 to column 80.

The adding amount of the hydrazine derivative may be an amount capable of forming a high contrast image. The amount is usually within the range of $10^{-6}$ to $10^{-1}$ moles, preferably $10^{-5}$ to $10^{-2}$ moles, per mole of silver halide even though the optimum amount is varied depending on the diameter, halide composition, and the degree of chemical sensitization of silver halide grain, and the kind of stabilizing agent.

The hydrazine derivative is added to the silver halide emulsion layer or a layer adjoined with the emulsion layer.

Compounds each described in the followings may be added to the layers constituting the silver halide photographic light-sensitive material of the invention.

(1) Dispersion of solid particles of dye

Compounds described in JP O.P.I. No. 7-5629, page (3), [0017], to page (16), [0042]

(2) Compound having an acidic group

Compounds described in JP O.P.I. No. 62-237445, page 292(8), lower left column, line 11, to page 309(25), lower right column, line 3

(3) Acidic polymer

Compounds described in JP O.P.I. No. 6-186659, page (10), [0036], to page (17), [0062]

(4) Sensitizing dye

Compounds described in JP O.P.I. No. 5-224330, page (3), [0017], to page (13), [0040]

Compounds described in JP O.P.I. No. 6-194771, page (11), [0042], to page (22), [0094]

Compounds described in JP O.P.I. No. 242533, page (2), [0015], to page (8), [0034]

Compounds described in JP O.P.I. No. 6-337492, page (3), [0012], to page (34), [0056]

Compounds described in JP O.P.I. No. 6-337494, page (4), [0013], to page (14), [0039]

(5) Super sensitizing agent

Compounds described in JP O.P.I. No. 6-347938, page (3), [0011], to page (16), [0066]

(6) Tetrazolium compound

Compounds described in JP O.P.I. No. 6-208188, page (8), [0059], to page (10), [0067]

(7) Pyridinium compound

Compounds described in JP O.P.I. No. 7-110556, page (5), [0028], to page (29), [0068]

(8) Redox compound

Compounds described in JP O.P.I. No. 4-245243, page 235(7), to page 250(22)

In the silver halide photographic light-sensitive material of the invention, the above-mentioned additives and another known additive may be added. Such the compounds are described in (RD) Nos. 17643 (December 1978), 18716 (November 1979) and 308119 (December 1989).

Examples of the silver halide photographic light-sensitive material to which the present invention can be applied, includes a X-ray film for direct radiography and fluororadiography, a reversal film for duplication of the radiography, a film for CT imager, a film for laser imager, and various kinds of photomechanical film.

Silver halide composition of the silver halide photographic light-sensitive material of the invention is preferably pure silver chloride, silver chlorobromide having a silver chloride content of not less than 60 mole-% or a silver iodochloride having a silver chloride content of not less than 60 mole-%.

The average diameter of silver halide grains is preferably not more than 0.7 $\mu$m, particularly 0.1 to 0.5 $\mu$m. "Grain diameter" is a term usually used and easily understood by ones skilled in the field of photographic science. The term of "grain diameter" means the diameter of a grain when the grain has a shape of sphere or a shape which can be approximated to a sphere. When the grain is a cube, the cube is converted to a sphere and the diameter of the sphere is defined as the diameter of the grain. As to the detail of the method for obtaining the average grain diameter, C. E. Mess & T. H. James, The Theory of The Photographic Process, third edition, p.p. 36–43, Macmillan, 1966, can be referred.

The silver halide grain may have any shape such as tabular, spherical, cubic, tetradecahedral, regular octahedral without any limitation. The grain diameter distribution is preferably narrow. A monodisperse emulsion is preferred in which 90%, desirably 95%, of the whole grains is fallen within the range of +40% of the average grain diameter.

As the method for reacting a soluble silver salt and a soluble halide salt, a single-jet method, a double-jet method, and a combination thereof may be applied.

The grain may be formed in the presence of excess silver ions, and may be contained in plural layers different from each other.

Silver halide emulsion and preparation methods thereof are described in Research Disclosure (RD) 17643 p.p. 22–23, December 1978, and the publications cited therein.

In the light-sensitive material of the invention, various compounds may-be added to for the purpose of preventing fogging or stabilizing the photographic properties in the course of preparation, storage or photographic processing of the light-sensitive material. Various compounds known as an anti-foggant or a stabilizing agent may be added, for example, an azole compound such as a benzothiazolium salt, a nitroindazole, a nitrobenzimidazole, a chlorobenzimidazole, a bromobenzimidazole, a mercaptothiazole, a mercaptobenzothiazole, a mercaptothiadiazole, an aminotriazole, a benzotriazole, a nitrobenzotriazole, and a mercaptotetrazole particularly 1-phenyl-5-mercaptotetrazole, a mercaptopyrimidine, a mercaptotriazine, a thioketone such as oxazolinethione, and an azaindene such as a triazaindene and a tetraazaindene, particularly a 4-hydroxy-1,3,3a,7-tetraazaindene, and a pentaazaindene, a benzenesulfonic acid, a benzene-sulfinic acid, and potassium bromide. A substituted or unsubstituted heterocyclic ring or condensed heterocyclic ring which contains one of N, O, S and Se, and a water-soluble halide are preferred.

An inorganic or organic hardener can be contained in the silver halide emulsion and the non-light-sensitive hydrophilic colloid relating to the invention. For example, the following compounds are usable singly of in combination: a chromium salt such as chromium alum, and chromium acetate, an aldehyde such as formaldehyde, glyoxal, and glutaraldehyde, an N-methylol compound such as dimethylolurea, and methylol-dimethylhidantoin, a dioxane derivative such as 2,3,-dihydroxydioxane, a reactive vinyl compound such as 1,3,5-triacryloyl-hexahydro-s-triazine, bis(vinylsulfonyl)methyl ether, and N,N'-methylene-bis-[β-(vinylsulfonyl)propionamide], a reactive halogen compound such as 2,4-dichloro-6-hydroxy-s-triazine a mucohalogenic acid such as mucochloric acid, and phenoxymucochloric acid, an isooxazole, a dialdehyde starch, a 2-chloro-6-hydroxytriazinylated gelatin, an isocyanate, and a carboxyl group reactive type hardener.

In the light-sensitive emulsion layer and/or non-light-sensitive-hydrophilic colloid layer, various kinds of known surfactant may be used for various purposes such as coating aid, anti-static, improvement of sliding ability, emulsification dispersion, prevention of adhesion and improvement of photographic properties.

In the light-sensitive material usable in the invention, various kinds of additives may be added other than the above-mentioned. The additives include a desensitizer, a plasticizer, a lubricant, a development accelerator, oil, and colloidal silica.

In concrete, additives described in DR 17643, p.p. 22–31 are usable as the foregoing additives.

Any known photographic processing agent is usable for processing the silver halide photographic light-sensitive material of the invention.

As the developing agent, for example, a dihydroxybenzene such as hydroquinone, and potassium hydroquinonemonosulfonate, a 3-pyrazolidone such as 1-phenyl-3-pyrazolidone, 1-phenyl-4-methyl-3-pyrazolidone, 1-phenyl-4,4-dimethyl-3-pyrazolidone, 1-phenyl-4-methyl-4-hydroxymethyl-3-pyrazolidone, and 1-phenyl-4,4-dihydroxymethyl-3-pyrazolidone, an aminophenol such as N-methyl-p-aminophenol, and mixture thereof, ascorbic acids such as ascorbic acid, sodium ascorbate, and erythorbic acid, and metal salts such as an iron salt of EDTA, an iron salt of DTPA, and nickel salt of DTPA, are usable singly or in combination.

Among them, a combination of ascorbic acid or its derivative and the foregoing 3-pyrazolidone or dihydroxybenzene is preferably used.

It is preferred that an alkaline agent (such as sodium hydroxide, and potassium hydroxide), and a pH buffering agent (such as a carbonate, phosphate, borate, acetic acid, citric acid, and alkanolamine) are added to the developing solution. The carbonate is preferred as the pH buffering agent. The adding amount of the carbonate is preferably 0.5 moles to 2.5 moles, more preferably 0.75 moles to 1.5 moles, per liter of the developing solution.

A dissolving aid such as polyethylene glycols and esters thereof, and alkanolamine, a sensitizer, a surfactant, a defoaming agent, an antifogant, for example, halides such as potassium bromide, and sodium bromide, nitrobenzimidazoles, nitrobenzimidazole, tetrazoles, and thiazoles, a chelating agent such as ethylenediaminetetraacetic acid and an alkali metal salt thereof, nitrylotriacatic acid, and polyphosphate, a development accelerator such as compounds described in U.S. Pat. No. 2,304,025, and Japanese Patent 74-45541, and a hardener such as glutaraldehyde and a bisulfite adduct thereof may be added to the developing solution according to necessity.

In the processing method of the invention, the silver halide photographic light-sensitive material of the invention is processed by the developing solution containing the above-mentioned components after exposure.

The developing solution to be used in the invention, pH value of the developing solution at the time of use is preferably 7.5 to 10.5, more preferably 8.5 to 10.4. Such the value of pH is lower than that of an usual developing solution, and the pH value is also preferred from the view point of safely handling and environment pollution. The pH value is optionally controlled by the foregoing pH buffering agent, hydrochloric acid and sulfuric acid.

A fixing solution having an usually used composition can be used in the processing method of the invention. The followings may be used as a fixing agent; a thiosulfate such as sodium thiosulfate, potassium thiosulfate, and ammonium thiosulfate, a thiocyanate such as sodium thiocyanate, potassium thiocyanate, and ammonium thiocyanate, and an organic sulfur compound capable of forming a soluble stable silver complex which are known as a fixing agent.

A water-soluble aluminum salt effective as a hardener such as aluminum chloride, aluminum sulfate, and potassium alum, or an aldehyde compound such as glutaraldehyde may be added to the fixing solution.

A preservative such as sulfite and bisulfate, a pH buffering agent such as acetic acid and citric acid, a pH controlling agent such as sulfuric acid, and a chelating agent having a softening ability for hard water may be contained in the fixing solution according to necessity.

The pH value of the fixing solution is preferable not less than 3 and less than 8. The light-sensitive material is washed or treated by a stabilizing bath after fixing. The stabilizing bath contains, for the purpose of stabilizing the image, an inorganic or organic acid or a salt thereof, or an alkaline agent or a salt thereof for adjusting the pH value of the surface of the light-sensitive material after processing to 3 to 8, such as a combination two or more selected from of a borate, a metaborate, a phosphate, a carbonate, potassium hydroxide, sodium hydroxide, ammonia water, a monocarboxylic acid, a dicarboxylic acid, a polycarboxylic acid, citric acid, oxalic acid, malic acid, and acetic acid, an aldehyde such as formalin, glyoxal, and glutaraldehyde, a chelating agent such as ethylenediaminetetraacetic acid or its alkali salt, nitrylotriacetate and a polyphosphate, an antimold agent such as phenol, 4-chlorophenol, cresol, o-phenylphenol, chlorophene, dichlorophene, formaldehyde, p-hydroxybenzoic acid ester, 2-(4-thiazoline)-benzimidazole, benzoisothiazoline-3-one, dodecyl-benzyl-methylammonium chloride, N-(fluorodichloro-methylthio)phthalimide, and 2,4,4'-trichloro-2'-hydroxydiphenyl ether, a tone controlling agent and/or remaining color improving agent such as a nitrogen-containing heterocyclic compound having a substituent of mercapto group, for example, sodium salt of 2-mercapto-5-sulfonic acid-benzimidazole, 1-phenyl-5-mercaptotetrazole, 2-mercaptobenzthiazole, 2-mercapto-5 propyl-1,3,4-triazole, and 2-mercptohypoxantine. Among them, the antimold agent is preferably contained. These compound may be replenished in a form of liquid or solid.

The replenishing amount of the developing solution is 50 to 150 ml, preferably 30 to 130 ml, per $m^2$ according to the demand to reduce the amount of waste liquid. The replenishing amount of the developing solution is an amount of solution to be replenished. In concrete, the amount is the volume of a solution prepared by dissolving a granuled developer replenisher by water.

The developer replenishing solution and the fixer replenishing solution may be each the same or different from the initial developing solution and the initial fixing solution charged in the processing tanks of the automatic processor, respectively. The initial developing solution and the initial fixing solution may be each prepared from a granuled processing composition, a concentrated processing composition or a solution to be used.

The temperature of the developing solution, fixing solution washing and/or stabilizing bath is preferably within the range of 10 to 45° C., and the temperature of each process may be independently controlled.

In the invention, the whole processing time from the time at which the front of the film is inserted to the automatic processor to the time at which the front of the film is come out from the drying zone of the processor, dry to dry, is preferably 10 to 120 seconds according to the demand to reduce the processing time.

EXAMPLES

The effects of the invention is described in concrete according to examples below. However, the embodiment of the invention is not limited to the examples.

Example 1

<Preparation support having a subbing layer>

Both sides of a polyester film support of 100 μm was subjected to a corona discharge treatment of $8W/m^2 \cdot min$. The following subbing coating liquid B-3 was coated on one side of the support so as to form subbing layer B-3 having a dry thickness of 0.8 μm. On the other side of the support, the following subbing coating liquid B-4 was coated so as to form a subbing layer having a dry thickness of 0.8 μm.

<Subbing liquid B-3>

Latex A: a latex of a copolymer of 30% by weight of butyl acrylate, 20% by weight of t-butyl acrylate, 25% by weight of styrene and 25% by weight of 2-hydroxyethyl acrylate

| | |
|---|---|
| (solid content: 30%) | 270 g |
| Compound (UL-1) | 0.6 g |
| Hexamethylene-1,6-bisethyleneurea | 0.8 g |
| Water to make | 1000 ml |

<Subbing liquid B-4>

Latex of a copolymer of 40% by weight of butyl acrylate, 20% by weight of styrene, and 40% by weight of glycidyl acrylate

| | |
|---|---|
| (solid content: 30%) | 270 g |
| Compound (UL-1) | 0.6 g |
| Hexamethylene-1,6-bisethyleneurea | 0.8 g |
| Water to make | 1000 ml |

Furthermore, the surface of the subbing layers B-3 and B-4 were subjected to a corona discharge treatment of 8 $W/m^2 \cdot min$. The following subbing liquid B-5 was coated on the subbing layer B-3 so as to form subbing layer B-5 having a dry thickness of 0.1 μm and the following subbing liquid B-6 was coated on the subbing layer B-4 so as to form a subbing layer B-6 having a dry thickness of 0.8 μm and an antistatic function.

<Subbing liquid B-5>

| | |
|---|---|
| Gelatin | 10 g |
| Compound (LU-1) | 0.2 g |
| Compound (LU-2) | 0.2 g |
| Compound (LU-3) | 0.1 g |

-continued

| | |
|---|---|
| Silica particle (average diameter: 3 μm) | 0.1 g |
| Water to make | 1000 ml |

<Subbing liquid B-6>

| | |
|---|---|
| Water-soluble electric conductive polymer (UL-4) | 60 g |
| Latex of compound (UL-5) (solid content: 20%) | 80 g |
| Ammonium sulfate | 0.5 g |
| Hardener (UL-6) | 12 g |
| Polyethylene glycol (weight average molecular weight: 600) | 6 g |
| Water to make | 1000 ml |

Subbing liquid shown in Table 1 were prepared in the same manner as subbing liquid B-3 except that latex A was replaced by the following Latex B, C , D or a combination thereof.

UL-1

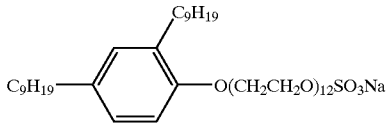

UL-2

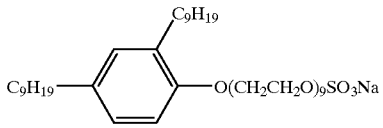

UL-3

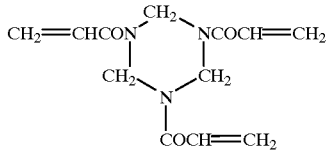

UL-4

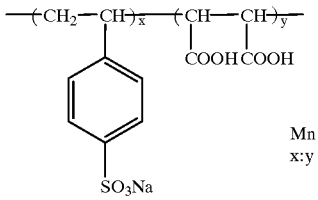

Mn = 5000
x:y = 75:25 (weight ratio)

UL-5

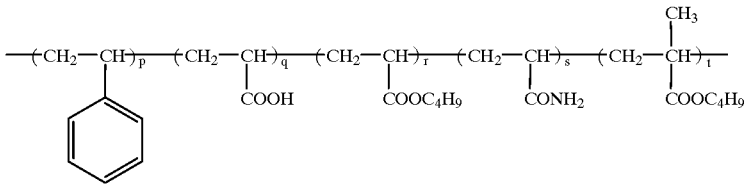

p:q:r:s:t = 40:5:10:5:40 (weight ratio)

-continued

UL-6

Mixture of

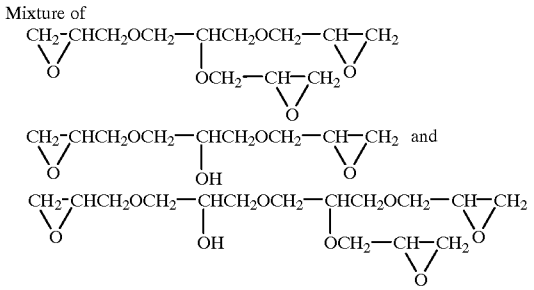

Latex A

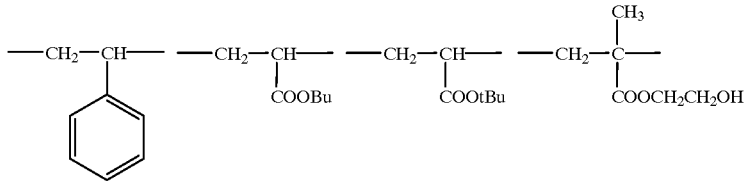

| ST | BA | TBA | HEMA |
|---|---|---|---|
| 25 | 30 | 20 | 25 wt% |

Latex B

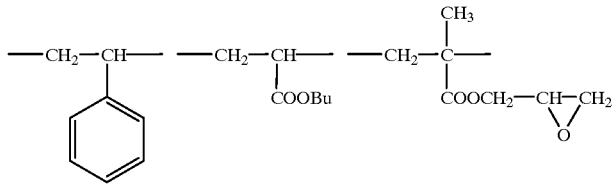

| ST | BA | GMA |
|---|---|---|
| 20 | 40 | 40 wt% |

Latex C

| ST | BA | TBA | HEMA |
|---|---|---|---|
| 27 | 10 | 35 | 28 wt% |

Latex D

| ST | GMA |
|---|---|
| 60 | 40 wt% |

<Preparation of silver halide emulsion A1>

Core grains of silver chlorobromide composed of 70 mole-% of silver chloride and the remainder of silver bromide, having an average diameter of 0.09 $\mu$m were prepared by a double-jet mixing method. A silver nitrate solution and a water-soluble halide solution are mixed by a double-jet method in the presence of $7\times10^{-8}$ moles of $K_3Rh(NO)_4(H_2O)_2$ and $8\times10^{-6}$ moles of $K_3OsCl_6$ per mole of silver after completion of the grain formation. The mixing was carried out at 40° C. and the pH at and $E_{Ag}$ of the solution were maintained at 3.0 and 165 mV, respectively. The $E_{Ag}$ value was lowered to 125 mV by a sodium chloride solution, and a shell was provided on the core grain by a double-jet method. At this time, $3\times10^{-7}$ moles of $K_2IrCl_6$ and $9\times10^{-8}$ moles of $K_3RhCl_6$ per moles of silver were added to the halide solution. Furthermore, KI conversion was applied to the emulsion using fine grains of silver iodide. Thus obtained emulsion was a core/shell type monodisperse emulsion (variation coefficient of 10%) comprised of cubic silver chloroiodobromide grains (composed of 70 mole-% of silver chloride, 0.2 mole-% of silver iodide and the remainder of silver bromide) having an average diameter of 0.14 $\mu$m.

Then the emulsion was desalted by the use of a modified gelatin described in JP O.P.I. No. 2-280139 (a gelatin in which an amino group thereof is replaced by phenylcarbamoyl group such as exemplified compound G-8 described in JP O.P.I. No. 2-280139, page 287(3)). The $E_{Ag}$ value of the emulsion after desalting was 190 mV at 50° C.

To thus obtained emulsion, $8.5\times10^{-4}$ moles per mole of silver of potassium bromide and citric acid were added so that the pH and $E_{Ag}$ were adjusted to 6.5 and 123 mV, respectively. Then $1\times10^{-3}$ mole of sodium p-toluenesulfonylchloramide (Choramine T) was added and reacted with the emulsion. After that, the emulsion was chemically ripened until the maximum sensitivity was obtained after addition of a dispersion of solid particles of elemental sulfur $S_8$ and $1.5\times10^{-5}$ moles of chloroauric acid. The dispersion of solid particles of sulfur was prepared by a 0.01% methanol solution of sulfur is mixed with the same amount of water and stand for 10 minutes to precipitate the sulfur particles having an average diameter of 300 nm. The temperature of the emulsion was lowered to 40k C and $1\times10^{-4}$ moles of 4-hydroxy-6-methyl-1,3,3a,7-tetraazaindene, $3\times10^{-4}$ moles of 1-phenyl-5-mercaptotetrazole, and $5\times10^{-3}$ moles of potassium iodide were added per mole of silver to the emulsion. Then pH was adjusted to 5.1 by citric acid and 100 mg sensitizing dye d-1 was added to the emulsion.

<Preparation of silver halide emulsion A2>

Silver halide emulsion A2 was prepared in the same manner as in silver halide emulsion Al except that the amount of $K_3RhCl_6$ in the shell portion was varied to $6\times10^{-8}$ mole. T e sensitivity of Emulsion A2 was 40% higher than that of Emulsion A1 when the same chemical ripening was applied.

<Preparation of silver halide photographic light-sensitive material containing a hydrazine derivative for photomechanical scanner use>

On a support having a subbing layer prepared as described above, a gelatin subbing layer of the following Receipt 1 was coated so that the gelatin amount was 0.55 g/m$^2$, on the subbing layer, silver halide emulsion layer 1 according to the following Receipt 2 was coated so that the amount of silver and gelatin were 1.73 g/m$^2$ and 0.66 g/m$^2$, respectively, on the emulsion layer 1, silver halide emulsion layer 2 according to the following Receipt 3 was coated so that the amount of silver and gelatin were 1.73 g/m$^2$ and 0.66 g/m$^2$, respectively, and a protective layer coating liquid according to Receipt 4 was coated on emulsion layer 2 so that the gelatin amount was 1.3 g/m$^2$. These layers was coated simultaneously. On the subbing layer of other sided of the support, a backing layer according to Receipt 5 was coated so that the gelatin amount was 2.3 g/m$^2$, and a backing protective layer according to Receipt 6 was coated on the backing layer so that the gelatin amount was 0.7 g/m$^2$. The layers on the emulsion coated side were coated simultaneously coated by a curtain coating method at a speed of 200 m/min. and cooled to set, then the layers on the backing side were simultaneously coated in the similar condition and cooled to set at −1k C. The layers on both side of the support were dried at the same time.

Receipt 1 (Composition of gelatin subbing layer)

| | |
|---|---|
| Gelatin | 0.55 g/m$^2$ |
| Saponine | 56.5 mg/m$^2$ |
| Solid particle dispersion AD-8 | 10 mg/m$^2$ |
| Sodium polystyrenesulfonate (average molecular weight: 500,000) | 10 mg/m$^2$ |
| Germicide Z | 0.5 mg/m$^2$ |

Receipt 2 (Composition of Silver halide emulsion layer 1)

| | |
|---|---|
| Silver halide emulsion Al | 1.73 g/m$^2$ in terms of silver |
| Hydrazine compound (exemplified) H-15 | $2 \times 10^{-3}$ moles/mole of Ag |
| Compound a | 100 mg/m$^2$ |
| 2-pyridinol | 1 mg/m$^2$ |
| Polymer latex L-1 (particle diameter: 0.25 μm) | 0.25 g/m$^2$ |
| Saponine | 20 mg/m$^2$ |
| 2-mercapto-6-hydroxypurin | 2 mg/m$^2$ |
| 2-mercaptopyrimidine | 1 mg/m$^2$ |
| n-propyl gallate | 25 mg/m$^2$ |
| Ascorbic acid | 20 mg/m$^2$ |
| EDTA | 25 mg/m$^2$ |
| Sodium polystyrenesulfonate | 15 mg/m$^2$ |

The pH value of the coating solution was 5.2

Receipt 3 (Composition of silver halide emulsion layer 2)

| | |
|---|---|
| Silver halide emulsion A2 | 1.73 g/m$^2$ in terms of silver |
| Hydrazine compound H-15 | $4 \times 10^{-3}$ moles/mole of Ag |
| Amino compound AM-1 | 7 mg/m$^2$ |
| 4-hydroxy-6-methyl-1,3,3a,7-tetraazaindene | $4 \times 10^{-3}$ moles/mole of Ag |
| Saponine | 20 mg/m$^2$ |
| 2-mercapto-6-hydroxypurin | 1 mg/m$^2$ |
| Nicontinamide | 1 mg/m$^2$ |
| n-propyl gallate | 25 mg/m$^2$ |
| Mercaptopyrimidine | 1 mg/m$^2$ |
| EDTA | 50 mg/m$^2$ |
| Dye f5 | 15 mg/m$^2$ |
| Polymer latex L2 (Type Lx-3 described in Example 3 of JP O.P.I. No. 5-66512) | 0.5 g/m$^2$ |
| Colloidal silica (average diameter: 0.05 μm) | 150 mg/m$^2$ |
| Dextrin compound (Towa Kasei: PO-20) | 0.3 g/m$^2$ |

Phthalated gelatin was used as gelatin and the pH of the coating liquid was 4.8

Receipt 4 (Composition of emulsion protective layer)

| | |
|---|---|
| Gelatin | 1.3 g/m$^2$ |
| Amino compound AM-1 | 14 mg/m$^2$ |

Matting agent: Spherical polymethyl methacrylate having an average particle diameter of 3.5 μm

| | |
|---|---|
| Irregular shaped silica having an average particle diameter of 8 μm | 12.5 mg/m$^2$ |
| Surfactant S1 | 20 mg/m$^2$ |
| Lubricant W1 | 75 mg/m$^2$ |
| Redox compound R1 | 30 mg/m$^2$ |
| Compound a | 50 mg/m$^2$ |
| Polymer latex L3 (average particle diameter: 0.1 μm) | 0.25 g/m$^2$ |
| Colloidal silica (average particle diameter: 0.05 μm) | Shown in Table 1 |
| Hardener h2 | 80 mg/m$^2$ |
| Hardener 1,3-vinylsulfonyl-2-propanol | 40 mg/m$^2$ |
| Sodium polystyrenesulfonate | 10 mg/m$^2$ |
| Germicide Z | 0.5 mg/m$^2$ |

The redox compound was dispersed by the following dispersion method and used.

<Dispersing method for the redox compound>

| | |
|---|---|
| Redox compound | 2 g |
| Ethyl acetate | 80 g |

The redox compound was dissolved according to the above-mentioned receipt and mixed with the following gelatin solution.

| | |
|---|---|
| 10% TK-AX (manufactured by Takemoto Yushi Co., Ltd.) | 6 g |
| 15% aqueous gelatin | 180 g |

The mixture was dispersed by a homogenizer after preliminary dispersion for 5 minuets. Then ethyl acetate was removed under a reduced pressure of 130 mmHg. Water was added to the dispersion to made 280 ml.

Receipt 5 (Composition of the backing layer)

| | |
|---|---|
| Gelatin | 0.6 g/m$^2$ |
| Sodium iso-amyl-n-decylsulfosuccinate | 5 mg/m$^2$ |
| Polymer latex L4 | 0.3 g/m$^2$ |
| Colloidal silica (average particle diameter: 0.05 μm) | 100 mg/m$^2$ |
| Sodium polystyrenesulfonate | 10 mg/m$^2$ |
| Dye f1 | 65 mg/m$^2$ |
| Dye f2 | 15 mg/m$^2$ |
| Dye f3 | 100 mg/m$^2$ |
| 1-phenyl-5-mercaptotetrazole | 10 mg/m$^2$ |
| Hardener h3 | 100 mg/m$^2$ |
| Zinc hydroxide | 50 mg/m$^2$ |
| Compound D | 10 mg/m$^2$ |
| EDTA | 50 mg/m$^2$ |

Receipt 6 (Protective layer for the backing layer)

| | |
|---|---|
| Gelatin | 0.4 g/m$^2$ |
| Matting agent | |
| Monodispersion of polymethyl methacrylate particle having an average particle diameter of 5 μm | 50 mg/m$^2$ |
| Irregular silica particle having | 12.5 mg/m$^2$ |

-continued

| | |
|---|---|
| an average diameter of 5 $\mu$m | |
| Sodium di-(2-ethylhexyl)-sulfosuccinate | 10 mg/m$^2$ |
| Surfactant S1 | Shown in Table 1 |
| Dye f1 | 65 mg/m$^2$ |
| Dye f2 | 15 mg/m$^2$ |
| Dye f3 | 100 mg/m$^2$ |
| SF-2 (Dispersion of solid particle) | 20 mg/m$^2$ |
| Compound a | 50 mg/m$^2$ |

-continued

| | |
|---|---|
| Hardener h2 | 20 mg/m$^2$ |
| Sodium polystyrenesulfonate | 10 mg/m$^2$ |

(The dispersion of solid particle was prepared by a method in which Dye SF2 was dissolved in an alkaline solution, and precipitated by addition of citric acid in an amount of 1.2 times of the amount of acid group of the dye.)

Sensitizing dye d-1

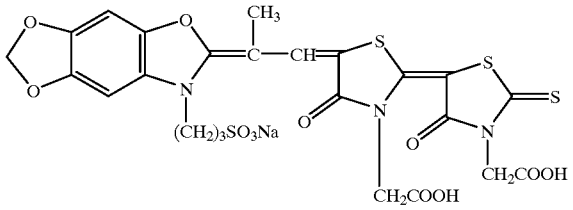

Amino compound AM-1

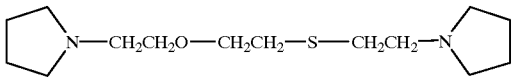

AD-8

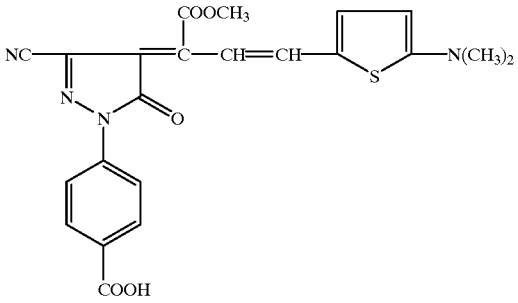

Dye f1

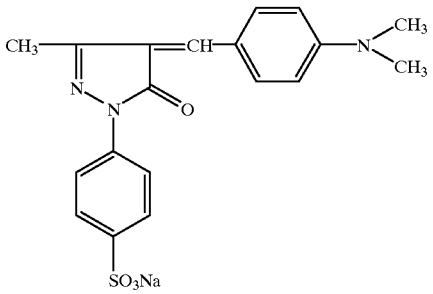

Dye f2

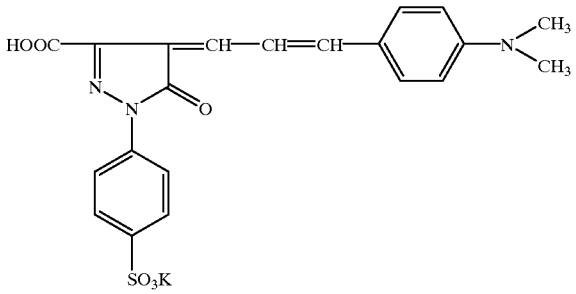

-continued
Dye f3
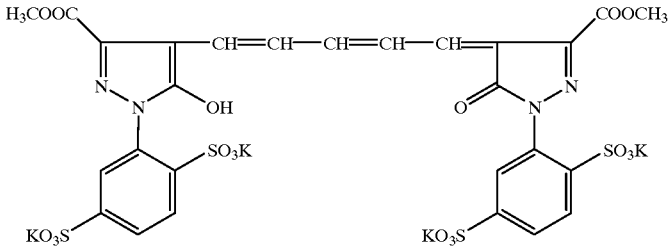
Hardener h3
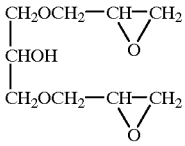
Germicide Z
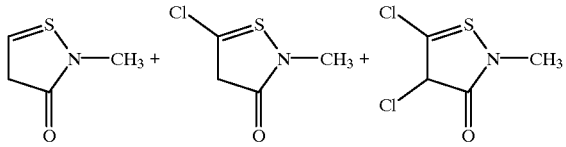
Compound a
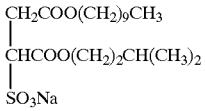
Polymer latex L1
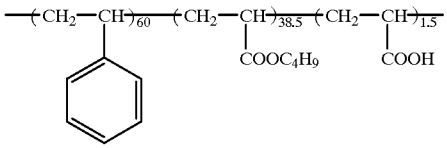
Redox compound R1
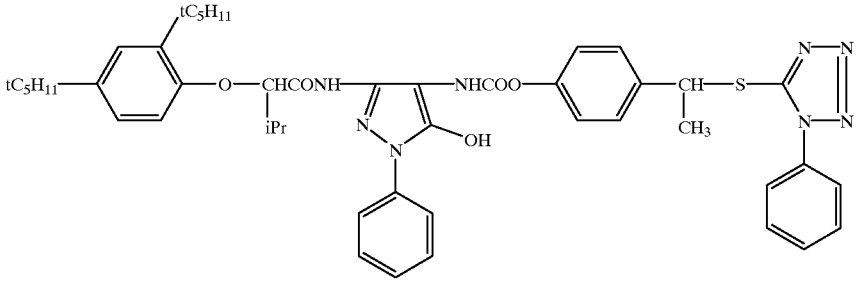
Hardener h2
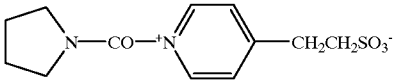
Surfactant S1
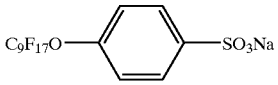
Polymer latex L4
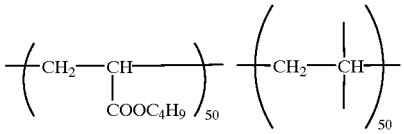

-continued

SF-2

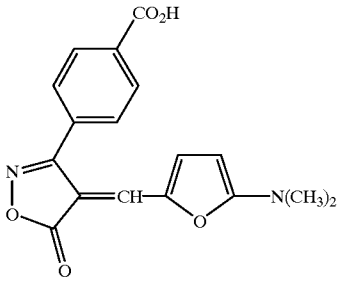

Polymer latex L3

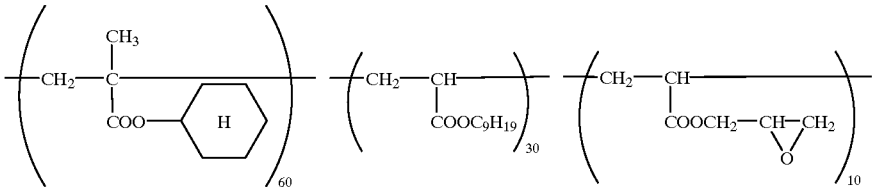

Lubricant W1

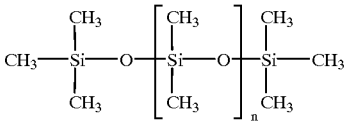

Polymer latex L2

(composition of type Lx-3 (9) described in JP O.P.I. 5-66512

Compound D

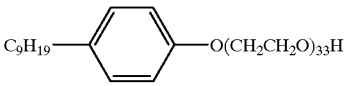

Dye f5

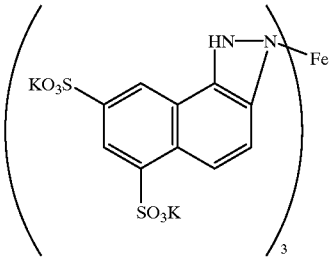

(Composition of developing solution) per 1 liter of using solution

| | |
|---|---|
| Pentasodium diethylenetriaminepentaacetate | 1 g |
| Sodium sulfite | 42.5 g |
| Potassium sulfite | 17.5 g |
| Potassium carbonate | 55 g |
| Erythorbic acid | 5 g |
| Hydroquinone | 20 g |
| 1-phenyl-4-methyl-4-hydroxymethyl-3-pyrazolidone | 0.85 g |
| Potassium bromide | 4 g |
| 5-methylbezotriazole | 0.2 g |
| Boric acid | 8 g |
| Diethylene glycol | 40 g |
| 8-mercaptoadenine | 0.3 g |

The pH value of the solution was adjusted to 10.4 by means of KOH.

(Composition of fixing solution) per 1 liter of using solution

| | |
|---|---|
| Ammonium thiosulfate (70% aqueous solution) | 200 ml |
| Sodium sulfite | 22 g |
| Boric acid | 9.8 g |
| Sodium acetate trihydrate | 34 g |
| Acetic acid (90% aqueous solution) | 14.5 g |
| Tartaric acid | 3.0 g |
| Aluminum sulfate (27% aqueous solution) | 25 ml |

The pH value of the solution was adjusted to 4.9 by means of sulfuric acid.

(Processing condition)

| (Processing step) | (Temperature) | (Time) |
|---|---|---|
| Development | 35° C. | 30 seconds |
| Fixing | 35° C. | 20 seconds |
| Washing | Ordinary temperature | 20 seconds |

-continued

| (Processing step) | (Temperature) | (Time) |
|---|---|---|
| Squeezing and drying | 50° C. | 30 seconds |
| Total | | 100 seconds |

(Evaluation of sensitivity and gamma value)

Each of the samples was exposed to light of 633 nm for $5\times10^{-7}$ seconds while stepwise varying light intensity by a laser sensitometer having a He-Ne laser as the light source. The exposed samples were processed an automatic processor GR-27, manufactured by Konica Corporation, according to the above-mentioned processing condition. The processed samples were subjected to densitometry by a digital densitometer PDA-65, manufactured by Konica Corporation.

The sensitivity was determined by a relative value of reciprocal of the light amount necessary to form a density of 2.5. Deviation of the sensitivities of all the samples fell within the range of 10%. Extremely high contrast images were obtained in all the samples and the gamma values of the samples were all 20 or more, which is measured in the density range of 0.1 to 3.0.

(Evaluation of peeling electrification)

The peeling electrification of the samples was measured by the foregoing method. Thus obtained results are shown in Table 1.

(Evaluation of scratch)

The sample cut in a size of 20 cm×30 cm was fixed on a desk top under a condition of 23° C. and 55% of relative humidity so that the emulsion surface was upward. The surface of the sample was strongly rubbed by a stainless steel rod having a diameter of 5 mm. Then the sample was processed under the foregoing condition. The total length of blackened scratch lines formed on the sample was measured and classified for 6 ranks according to the following norms.

Rank 6: The total length of scratch lines was less than 5 cm.

Rank 5: 5 cm to less than 10 cm

Rank 4: 10 cm to less than 15 cm

Rank 3: 15 cm to less than 20 cm

Rank 2: 20 cm to less than 25 cm

Rank 1: 25 cm or more

A light-sensitive material ranked at Rank 3 or less is not acceptable for practical use.

Results of the evaluation are shown in Table 1.

TABLE 1

| Sample No. | Kind of latex in subbing layer | Tg of subbing layer (° C.) | Colloidal silica* (mg/m$^2$) | Amount of S1 (mg/m$^2$) | Peeling electrification (pc/cm$^2$) | Level of scratch | Remarks |
|---|---|---|---|---|---|---|---|
| 1 | B | 2 | 150 | 0 | 300 | 1 | Comp. |
| 2 | B/A = 7/3 | 10 | 150 | 0 | 300 | 1.5 | Comp. |
| 3 | A | 30 | 150 | 0 | 300 | 2 | Comp. |
| 4 | A/C = 7/3 | 40 | 150 | 0 | 300 | 1.5 | Comp. |
| 5 | A/C = 4/6 | 50 | 150 | 0 | 300 | 2 | Comp. |
| 6 | C | 64 | 150 | 0 | 300 | 2 | Comp. |
| 7 | D | 74 | 150 | 0 | 300 | 1.5 | Comp. |
| 8 | B | 2 | 450 | 0 | 300 | 2 | Comp. |
| 9 | B/A = 7/3 | 10 | 450 | 0 | 300 | 2 | Comp. |
| 10 | A | 30 | 450 | 0 | 300 | 2 | Comp. |
| 11 | A/C = 7/3 | 40 | 450 | 0 | 300 | 4 | Inv. |
| 12 | A/C = 4/6 | 50 | 450 | 0 | 300 | 4.5 | Inv. |
| 13 | C | 64 | 450 | 0 | 300 | 4.5 | Inv. |
| 14 | D | 74 | 450 | 0 | 300 | 4.5 | Inv. |
| 15 | A/C = 4/6 | 50 | 150 | 2.5 | −20 | 2 | Comp. |
| 16 | A/C = 4/6 | 50 | 150 | 2 | 0 | 4 | Inv. |
| 17 | A/C = 4/6 | 50 | 150 | 1.75 | 50 | 4 | Inv. |
| 18 | A/C = 4/6 | 50 | 150 | 1.5 | 100 | 4 | Inv. |
| 19 | A/C = 4/6 | 50 | 150 | 1 | 200 | 4 | Inv. |
| 20 | A/C = 4/6 | 50 | 150 | 0.5 | 250 | 2.5 | Comp. |
| 21 | A/C = 4/6 | 50 | 450 | 1.5 | 100 | 5 | Inv. |
| 22 | A/C = 4/6 | 50 | 650 | 1.5 | 100 | 5 | Inv. |
| 23 | A/C = 4/6 | 50 | 900 | 1.5 | 100 | 5 | Inv. |

*In table 1, the amount of colloidal silica is the total amount of colloidal silica contained in Emulsion later 2 and the emulsion protective layer.

As is shown in Table 1, the samples of the invention are considerably superior to the comparative samples in the scratch damage. Furthermore, it is understood that the peeling electrification with respect of isoprene rubbed is reduced by the addition of surfactant S1. The samples of the invention all have extremely high contrast without any degradation in the photographic property.

Example 2

Samples were prepared in the same manner as in Example 1 except that the colloidal silica in Receipt 3 is replaced with composite latex L1 of the invention. The samples were evaluated in the same manner as in Example 1. Thus obtained results are shown in the followings.

TABLE 2

| Sample No. | Kind of latex in subbing layer | Tg of subbing layer (° C.) | Colloidal silica* ($mg/m^2$) | Amount of S1 ($mg/m^2$) | Peeling electrification ($pc/cm^2$) | Level of scratch | Remarks |
|---|---|---|---|---|---|---|---|
| 24 | A/C = 4/6 | 50 | 450 | 1.5 | 100 | 6 | Inv. |
| 25 | A/C = 4/6 | 50 | 650 | 1.5 | 100 | 6 | Inv. |
| 26 | A/C = 4/6 | 50 | 900 | 1.5 | 100 | 6 | Inv. |

As is shown in the Table, the peeling electrification is reduced in the samples of the invention and the scratch pressure marks are reduced accompanied with that. Any degradation in the photographic property was not observed at all.

Example 3

The foregoing samples 18, 21 and 24 were subjected to evaluation of crack formation under a low humidity and a high temperature.

The samples were packed in an airtight package together with dried silica gel and stood for 5 days at 55° C. The samples were observed with a magnifying glass with a magnitude of 15, manufactured by Peak Co., Ltd. The number of crack in one field of the glass was countered. The crack number of not more than 5 is preferred for practical use. Results of the evaluation are listed in Table 3.

TABLE 3

| Sample No. | Number of crack |
|---|---|
| 18 | 25 |
| 21 | 24 |
| 24 | 4 |

It is understood from the results in Table 3 that the sample using the composite latex according to the invention is considerably improved in the number of the crack and in the overall physical property of the layer compared to the samples using colloidal silica.

What is claimed is:

1. A silver halide photographic light-sensitive material comprising a support having thereon a subbing layer having a glass transition point Tg of 40° C. to 200° C. which consists essentially of a hydrophobic resin, and a silver halide emulsion layer and optionally a non-light-sensitive hydrophilic colloid layer provided on said subbing layer, and at least one of said silver halide emulsion layer and said non-light-sensitive hydrophilic colloid layer contains an inorganic colloidal particle or a composite latex comprising an inorganic particle and a hydrophobic resin in an amount of 0.1 $g/m^2$ to 2.0 $g/m^2$ in total, and said silver halide emulsion layer or said non-light-sensitive hydrophilic colloid layer contains a hydrazine derivative.

2. The light-sensitive material of claim 1, wherein the peeling electrification generated by peeling the light-sensitive material from the surface of isoprene rubber plate is 0 to 200 picocoulomb/$cm^2$ under a condition of a temperature of 23° C. and a relative humidity of 55%.

3. The light-sensitive material of claim 1, wherein said inorganic colloidal particle is colloidal silica.

4. The light-sensitive material of claim 1, wherein said composite latex comprises a silica particle and hydrophobic resin.

* * * * *